US012152845B2

(12) United States Patent
Zhang

(10) Patent No.: US 12,152,845 B2
(45) Date of Patent: Nov. 26, 2024

(54) LOCK STRUCTURE WITH IMPROVED SAFETY, AND GUN LOCK

(71) Applicant: Shenzhen Hanmai Technology Co., Ltd., Shenzhen (CN)

(72) Inventor: Wenyuan Zhang, Zhangshu (CN)

(73) Assignee: Shenzhen Hanmai Technology Co., Ltd., Shenzhen (CN)

( * ) Notice: Subject to any disclaimer, the term of this patent is extended or adjusted under 35 U.S.C. 154(b) by 16 days.

(21) Appl. No.: 18/117,488

(22) Filed: Mar. 6, 2023

(65) Prior Publication Data

US 2023/0213297 A1 Jul. 6, 2023

(30) Foreign Application Priority Data

Mar. 21, 2022 (CN) ..... 202220627948.X
Dec. 16, 2022 (CN) ..... 202223400703.2

(51) Int. Cl.
*F41A 17/02* (2006.01)
*F41A 17/06* (2006.01)
*F41A 17/54* (2006.01)

(52) U.S. Cl.
CPC ..... *F41A 17/02* (2013.01); *F41A 17/06* (2013.01); *F41A 17/066* (2013.01); *F41A 17/54* (2013.01); *F41A 17/063* (2013.01)

(58) Field of Classification Search
CPC ..... F41A 17/00; F41A 17/02; F41A 17/46; F41A 17/54
See application file for complete search history.

(56) References Cited

U.S. PATENT DOCUMENTS 2,742,726 A * 4/1956 Feller ..... F41A 17/54 42/70.07
3,624,945 A * 12/1971 Foote ..... F41A 17/02 42/70.07
4,499,681 A * 2/1985 Bako ..... E05B 67/36 42/70.07
5,392,552 A * 2/1995 McCarthy ..... F41A 17/54 42/70.07
5,487,234 A * 1/1996 Dragon ..... F41A 17/06 42/70.07

(Continued)

FOREIGN PATENT DOCUMENTS

CN 201653259 U * 11/2010 ..... F41A 17/54
CN 102296890 A * 12/2011 ..... F41A 17/54

(Continued)

*Primary Examiner* — Gabriel J. Klein
(74) *Attorney, Agent, or Firm* — Hemisphere Law, PLLC; Zhigang Ma

(57) ABSTRACT

The present disclosure relates to the technical field of special locks. The lock structure with improved safety includes a support assembly, a fixed cavity and an unlocking cavity; the fixed cavity is provided with a lock beam; the unlocking cavity is provided with a lockhole and a locking device; the lock beam is threaded into a trigger position of a gun and then into the lockhole and is locked by the locking device; an inner wall of the lockhole extends into the unlocking cavity to form a lockhole ring; a convex rib is arranged on an inner wall of the lockhole ring; a groove is formed in an outer wall of the lock beam; the convex rib and the groove are connected with each other in an embedded manner, so that the lock beam is stabilized in the lockhole ring.

12 Claims, 18 Drawing Sheets

(56) References Cited

U.S. PATENT DOCUMENTS 5,638,627 A * 6/1997 Klein ..... F41A 17/54 42/70.07
5,704,152 A * 1/1998 Harrison ..... F41A 17/04 42/70.07
5,899,102 A * 5/1999 Ling ..... F41A 17/54 42/70.07
6,205,695 B1 * 3/2001 Schnell ..... F41A 17/54 42/70.07
6,209,251 B1 * 4/2001 Avganim ..... F41A 17/54 42/70.07
6,269,575 B1 * 8/2001 Chang ..... F41A 17/54 42/70.07
6,308,540 B1 * 10/2001 Lee ..... E05B 73/0005 42/70.07
6,487,803 B1 * 12/2002 Yu ..... F41A 17/54 42/70.07
2001/0011432 A1 * 8/2001 Schnell ..... F41A 17/54 42/70.07
2002/0069569 A1 * 6/2002 Riebling ..... F41A 17/54 42/70.07
2002/0095845 A1 * 7/2002 Sapia ..... F41A 17/54 42/70.07
2005/0044910 A1 * 3/2005 Sloan ..... E05B 37/00 70/202
2005/0229654 A1 * 10/2005 Victor ..... F41A 17/063 70/58
2009/0272160 A1 11/2009 Chang
2012/0006080 A1 1/2012 Yu et al.
2016/0060905 A1 3/2016 Shiu et al.
2018/0356172 A1 * 12/2018 Mack ..... F41A 17/066
2019/0212086 A1 * 7/2019 Shiner ..... F41A 17/54
2021/0247158 A1 * 8/2021 Takach, Jr. ..... F41A 17/54
2024/0159486 A1 * 5/2024 Lu ..... F41A 17/46

FOREIGN PATENT DOCUMENTS

CN 113606986 A * 11/2021
WO WO-2014182698 A1 * 11/2014 ..... F41A 17/06

* cited by examiner

LOCK STRUCTURE WITH IMPROVED SAFETY, AND GUN LOCK

TECHNICAL FIELD

The present disclosure relates to the technical field of special locks, in particular, to a lock structure with improved safety, and a gun lock.

BACKGROUND

Gun is a very dangerous instrument with powerful lethality. It must be kept strictly to prevent loss or misuse. Especially for teenagers, they may mistake guns for toys and use them at will, leading to major accidents. Therefore, it is necessary to keep guns safely and use locks to restrict them, so as to avoid the guns from being stolen or misused.

a current gun lock can also be used to lock a gun, but a spring bolt and a lockhole are not stably connected, which can easily lead to deformation of the lockhole after the gun lock is repeatedly use or when the gun lock is damaged by violence. As a result, a lock beam falls out when the gun lock is still locked, and an original protection function of the lock will not work. In addition, a person easily inserts an iron wire or a flat needle into the lockhole to destroy a locking device, so that the original protection function of the lock will not work.

At the same time, existing gun locks usually do not have an independent support, so that the gun locks need to be placed on separate gun safes or gun racks, making it difficult to take the gun locks, and it is also unsafe. Unified storage and management of guns will also lead to delayed response in an emergency, resulting in loss of life and properties.

Therefore, how to improve the safety while also conveniently place a gun lock is a technical problem to be solved.

SUMMARY

In order to overcome the above deficiencies, the present disclosure aims to provide a technical solution capable of solving the above problems.

A lock structure with improved safety includes a fixed cavity and an unlocking cavity which are spaced apart from each other by a certain space and are in locked connection; the fixed cavity is provided with a lock beam extending out of the fixed cavity; the unlocking cavity is provided with a lockhole for the lock beam to be threaded in, and a locking device for locking the lock beam; the lock beam is threaded into a trigger position of a gun and then into the lockhole, and is locked by the locking device, so that the gun is locked in the space after the fixed cavity and the unlocking cavity are in locked connection; an inner wall of the lockhole extends into the unlocking cavity to form a lockhole ring; a convex rib is arranged on an inner wall of the lockhole ring; a groove is formed in an outer wall of the lock beam; the lock beam is threaded into the lockhole, and moves in the lockhole ring; and the convex rib and the groove are connected with each other in an embedded manner, so that the lock beam is stabilized in the lockhole ring.

Preferably, one part of a sector ring of the lockhole ring is formed into a long sector ring, and the other part of the sector ring of the lockhole ring is formed into a short sector ring; a distance between a top of the long sector ring and a plane of the lockhole is set to be a first length; a distance between a top of the short sector ring and the plane of the lockhole is set to be a second length; the first length is greater than the second length; a notch is formed in the short sector ring of the lockhole ring; and the locking device is in locked connection with the lock beam through the notch.

Preferably, two groups of convex ribs are arranged on the inner wall of the lockhole ring; two groups of grooves are arranged on the inner wall of the lock beam; the two groups of convex ribs and the two groups of grooves are respectively connected with each other in the embedded manner; lengths of one group of convex ribs in an axial direction of the lockhole ring are equal to the first length; and lengths of the other group of convex ribs in the axial direction of the lockhole ring are equal to the second length.

Preferably, the locking device is provided with a spring bolt, a spring bolt rack, a sliding block, a push spring and an unlocking device; the spring bolt rack is located on one side of the spring bolt opposite to the lock beam; the lock beam is provided with a lock beam rack; the lock beam rack and the spring bolt rack are clamped with each other to form locked connection; the unlocking device drives the sliding block to move, thereby driving the spring bolt rack to be separated from the lock beam rack to relieve the locked connection; and the push spring is used for driving the sliding block to reversely move and be reset, thereby driving the spring bolt rack to be in locked connection with the lock beam rack again.

Preferably, the spring bolt rack has a topland, a root surface and a bottom land; a distance between the topland and the root surface is set to be a first thickness; a distance between the topland and the bottom land is set to be a second thickness; and a numerical value of the first thickness is 0.4 to 0.6 times that of the second thickness.

Preferably, the unlocking device is provided with a mechanical lock cylinder, a mechanical rotating shaft and a mechanical key; one end of the mechanical rotating shaft is fixedly connected to a rotating component of the mechanical lock cylinder; the other end of the mechanical rotating shaft abuts against the sliding block; the mechanical key is inserted into the mechanical lock cylinder to enable the rotating component to rotate, thereby driving the mechanical rotating shaft to rotate; and the mechanical rotating shaft rotates to drive the sliding block, abutting against the mechanical rotating shaft, to move, thereby relieving the locked connection.

Preferably, the unlocking device is provided with a motor, a cam, a circuit board, a processor chip, a battery, a power data interface and a recognition assembly; one end of the cam is fixedly connected to a drive shaft of the motor, and the other end of the cam abuts against the sliding block; the motor, the processor chip, the battery, the power data interface and the recognition assembly are electrically connected to the circuit board respectively; the processor chip is used for driving, according to a recognition result of the recognition assembly, the motor to rotate, and driving the cam to rotate; and the cam rotates to drive the sliding block, abutting against the cam, to move, thereby relieving the locked connection.

Preferably, the recognition assembly is provided with a fingerprint recognition module; the fingerprint recognition module is electrically connected with the circuit board; and the fingerprint recognition module is exposed out of a housing of the unlocking cavity, so as to facilitate fingerprint recognition.

Preferably, the recognition assembly is provided with a button recognition module; the button recognition module comprises a contact button and a press housing; the contact button is electrically connected with the circuit board; one end of the press housing abuts against the contact button, and the other end of the press housing is exposed out of the housing of the unlocking cavity, thereby facilitating pressing.

Preferably, a fixing ring and a fixing block which are fixedly connected with each other are arranged inside the fixed cavity; the fixing block is fixedly connected inside the fixed cavity; the other end of the lock beam relative to the lock beam rack is in press-fit with the fixing ring, so that the lock beam is fixed in the fixing ring; a threaded hole is formed in an end socket of one end of the lock beam pressed into the fixing ring, and a pin hole is formed in a position, corresponding to the threaded hole, on the fixing block; and the lock beam is in bolted connection with the fixing block through the threaded hole.

The present disclosure further provides a gun lock, including: a support assembly; a fixed cavity, wherein the fixed cavity is fixedly connected with the support assembly, and the fixed cavity is provided with a lock beam; an unlocking cavity, wherein the unlocking cavity is flexibly connected with the fixed cavity, and the unlocking cavity is provided with a lockhole; and a locking device, wherein the locking device is arranged in the unlocking cavity, wherein the lock beam is used for being fixedly clamped at a trigger of a gun, and the lock beam is clamped with the locking device after passing through the lockhole.

Preferably, the fixed cavity further includes a first front shell, a first rear shell and a push assembly; the first front shell is flexibly connected with the unlocking cavity, and the first front shell is fixedly connected with the first rear shell to form a first cavity; and the push assembly is arranged in the first cavity.

Preferably, the push assembly includes a first fixed plate, a fixing block, a push post and a first spring; both the first fixed plate and the fixing block are arranged in the first cavity; both the first front shell and the first fixed plate are provided with through holes; the lock beam is arranged on the fixing block; the push post abuts against the fixed cavity after passing through the through holes; and the first spring abuts against the fixing block and the push post respectively.

Preferably, the unlocking cavity further includes a second front shell, a second rear shell and a second fixed plate; the second front shell is flexibly connected with the fixed cavity; the second front shell is fixedly connected with the second rear shell to form a second cavity; both the second fixed plate and the locking device are arranged in the second cavity; the second fixed plate is provided with a sliding chute; the locking device includes a sliding block; and the sliding block is arranged in the sliding chute, and moves in the sliding chute to be intermittently clamped to and separated from the lock beam.

Preferably, the locking device further includes a mechanical lock cylinder; the mechanical lock cylinder is provided with a mechanical rotating shaft; and the mechanical rotating shaft rotates with the mechanical lock cylinder to drive the sliding block to move in the sliding chute.

Preferably, the sliding block is provided with a push spring; and the push spring abuts against the sliding block and the mechanical lock cylinder respectively to drive the sliding block to be clamped with the lock beam.

Preferably, the locking device further includes a circuit board and a motor; the circuit board is electrically connected with the motor; the motor is provided with a cam; and the cam rotates with the motor to drive the sliding block to move in the sliding chute.

Preferably, the sliding block is provided with a position detection switch; the position detection switch is in signal connection with the motor; and the position detection switch is triggered intermittently with movement of the sliding block to control the motor to anticlockwise rotate and be reset.

Preferably, the circuit board is provided with a fingerprint recognition module; and the fingerprint recognition module is electrically connected with the circuit board.

Preferably, the circuit board is provided with a button recognition module; and the button recognition module is electrically connected with the circuit board.

Compared with the prior art, the present disclosure has the following beneficial effects.

Based on the convex rib, the groove and the lockhole ring, stability of connection between the unlocking cavity and the lock beam is improved. Furthermore, by means of combining the long sector ring with the short sector ring, a possibility that the lock is destroyed by an external force is also decreased, and the safety of the lock is improved. By means of thickening the spring bolt rack, such a phenomenon of a decrease in the safety caused by a decline of the tightness of the locked connection between the spring bolt rack and the lock beam rack, and at the same time, a risk that the lock beam slides out of the spring bolt rack in case of man-made sabotage is lowered. Unlocking by using different unlocking devices improves the universality of the lock and the convenience of unlocking. Based on the support assembly, the fixed cavity is fixedly mounted on the support assembly, and the lock beam in the fixed cavity and the locking device in the unlocking cavity are jointly used to lock the trigger of the gun. The support assembly can be fixedly mounted at many positions, such as a gun safe, a security booth, an airport and a bank, which not only effectively improves the safety of the gun, but also can effectively increase a response speed in an emergency. A gun can be obtained without going to a weapons depot. The lock beam is used for being fixedly clamped to a trigger of a gun. On the one hand, the gun is fixed and is prevented from being lost. On the other hand, the lock beam can still lock the trigger of the gun even if the gun is lost to prevent the gun from being used. The present disclosure has the advantages and safety and efficiency.

The additional aspects and advantages of the prevent disclosure will be provided in the following descriptions, part of which will become apparent from the following descriptions or be learned through the practice of the prevent disclosure.

BRIEF DESCRIPTION OF THE DRAWINGS

To describe the embodiments of the present disclosure or the technical solutions in the existing art more clearly, drawings required to be used in the embodiments or the illustration of the existing art will be briefly introduced below. Obviously, the drawings in the illustration below are only some embodiments of the present disclosure. Those ordinarily skilled in the art also can acquire other drawings according to the provided drawings without doing creative work.

Figure 1:
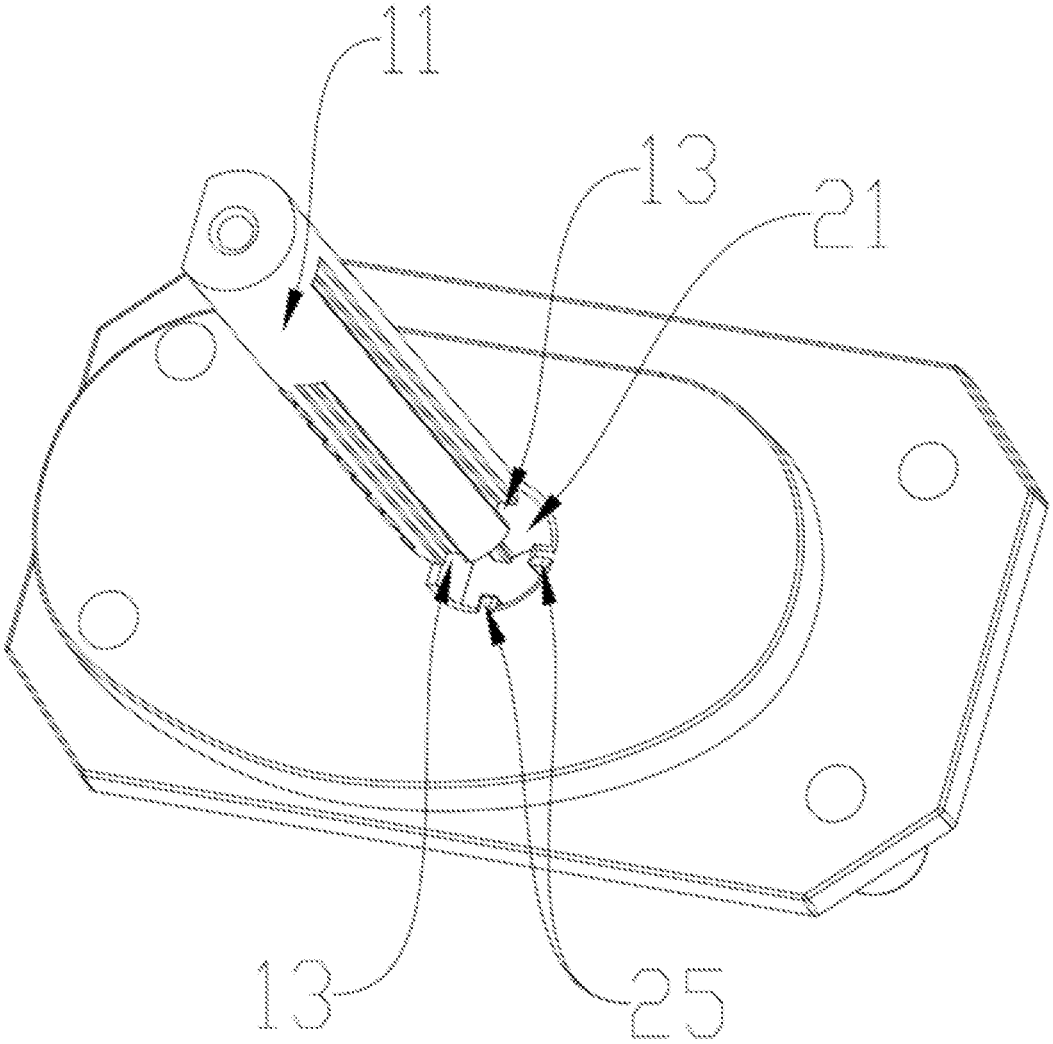
FIG. 1 is a schematic structural diagram of a lock beam and a lockhole of the present disclosure.

Reference numerals and names in the drawings are as follows:

10: fixed cavity; 11: lock beam; 12: lock beam rack; 13: groove; 14: fixing ring; 15: fixing block; 16: threaded hole; 17: first front shell; 18: the first rear shell; 20: unlocking cavity; 21: lockhole; 22: lockhole ring; 23; long sector ring; 24: short sector ring; 25 convex rib; 28: notch; 202: second front shell; 203: second rear shell; 204: second fixed plate; 205: sliding chute; 30: locking device; 31: spring bolt; 32: spring bolt rack; 33: topland; 34: root surface; 35: bottom land; 41: sliding block; 42: push spring; 43: position detection switch; 50: unlocking device; 51: mechanical lock cylinder; 52: mechanical rotating shaft; 53: mechanical key; 61: motor; 62: cam; 63: circuit board; 64: processor chip; 65: battery; 66: power supply data interface; 67: recognition assembly; 68: fingerprint recognition module; 70: button recognition module; 71: contact button; 72: press housing; 80: support assembly; 81: first fixed frame; 82: second fixed frame; 90: push assembly; 91: first fixed plate; 92: push post; 93: first spring; and 94: through hole.

DETAILED DESCRIPTION OF THE EMBODIMENTS

The technical solutions in the embodiments of the present disclosure will be clearly and completely described below. Apparently, the described embodiments are only a part of the embodiments of the present disclosure, rather than all the embodiments. All other embodiments obtained by those of ordinary skill in the art based on the embodiments in the present disclosure without creative work shall fall within the protection scope of the present disclosure.

Figure 2:
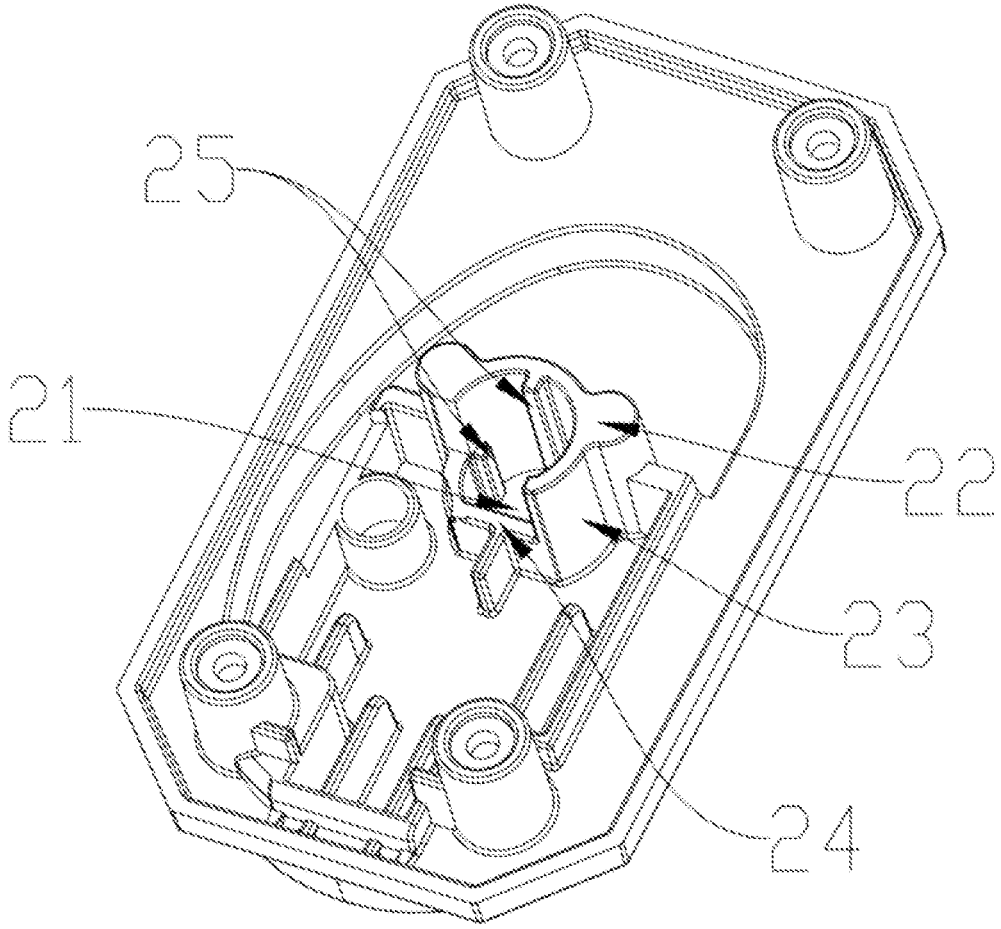
FIG. 2 is a schematic structural diagram of a lockhole ring of the present disclosure.
Figure 3:
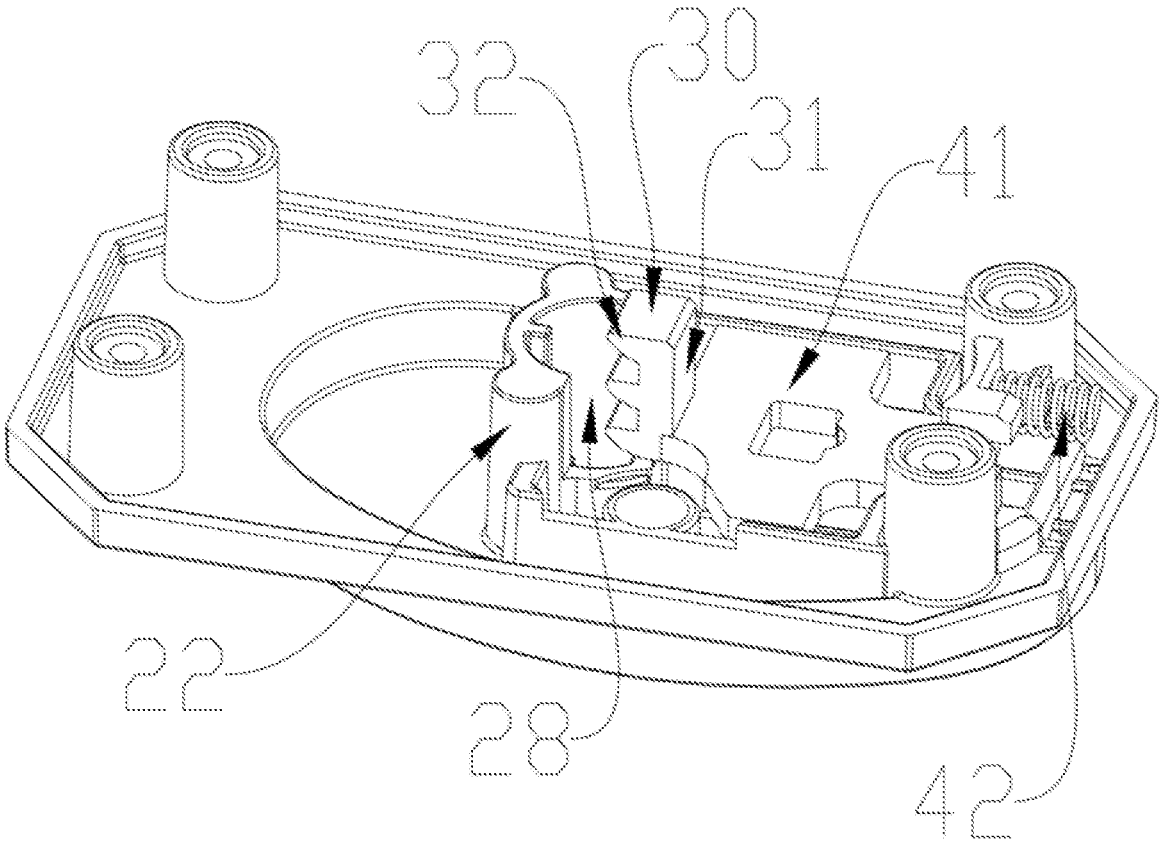
FIG. 3 is a schematic structural diagram of a spring bolt of the present disclosure.
Figure 4:
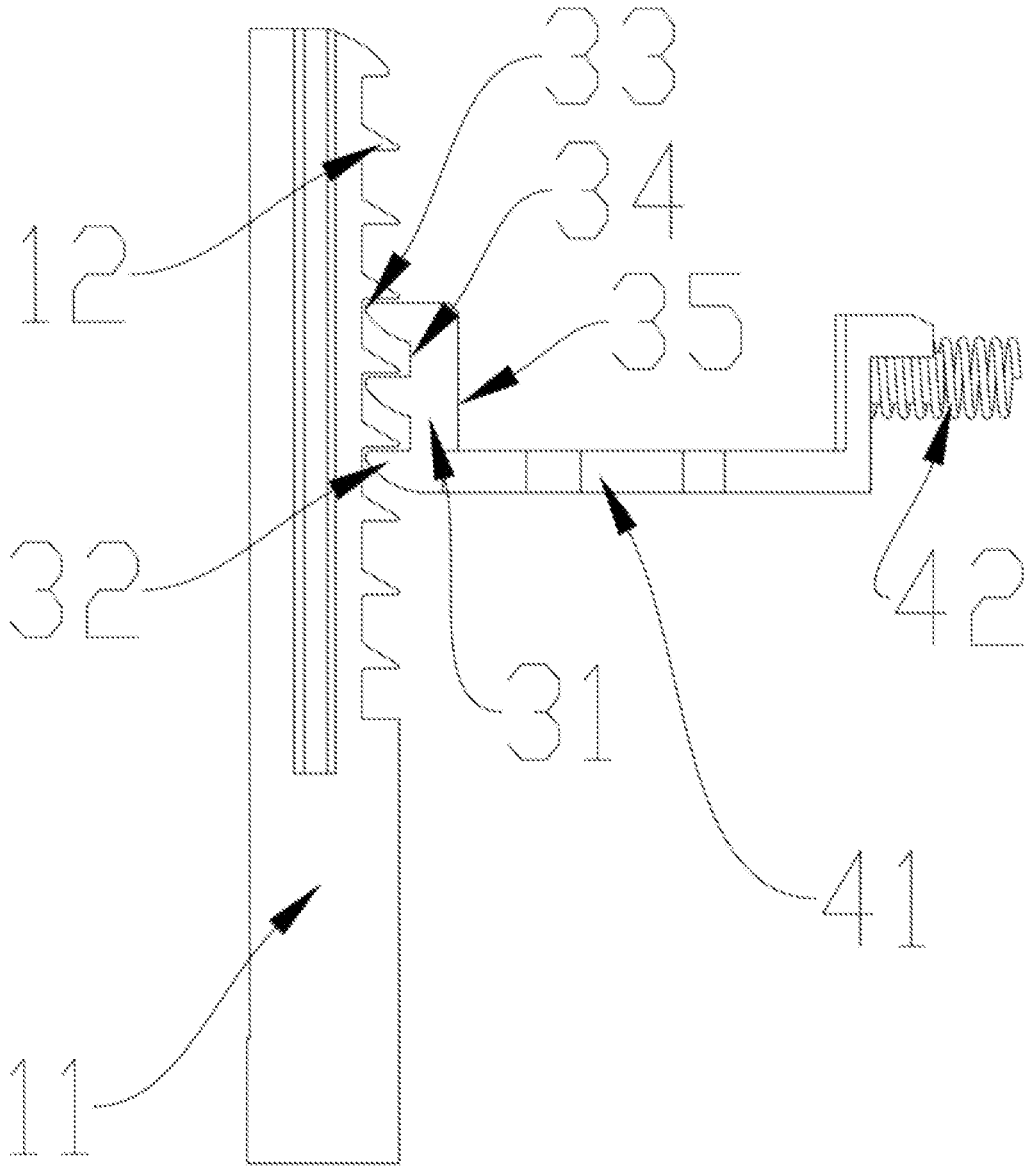
FIG. 4 is a schematic structural diagram of locked connection between a lock beam and a spring bolt of the present disclosure.
Figure 5:
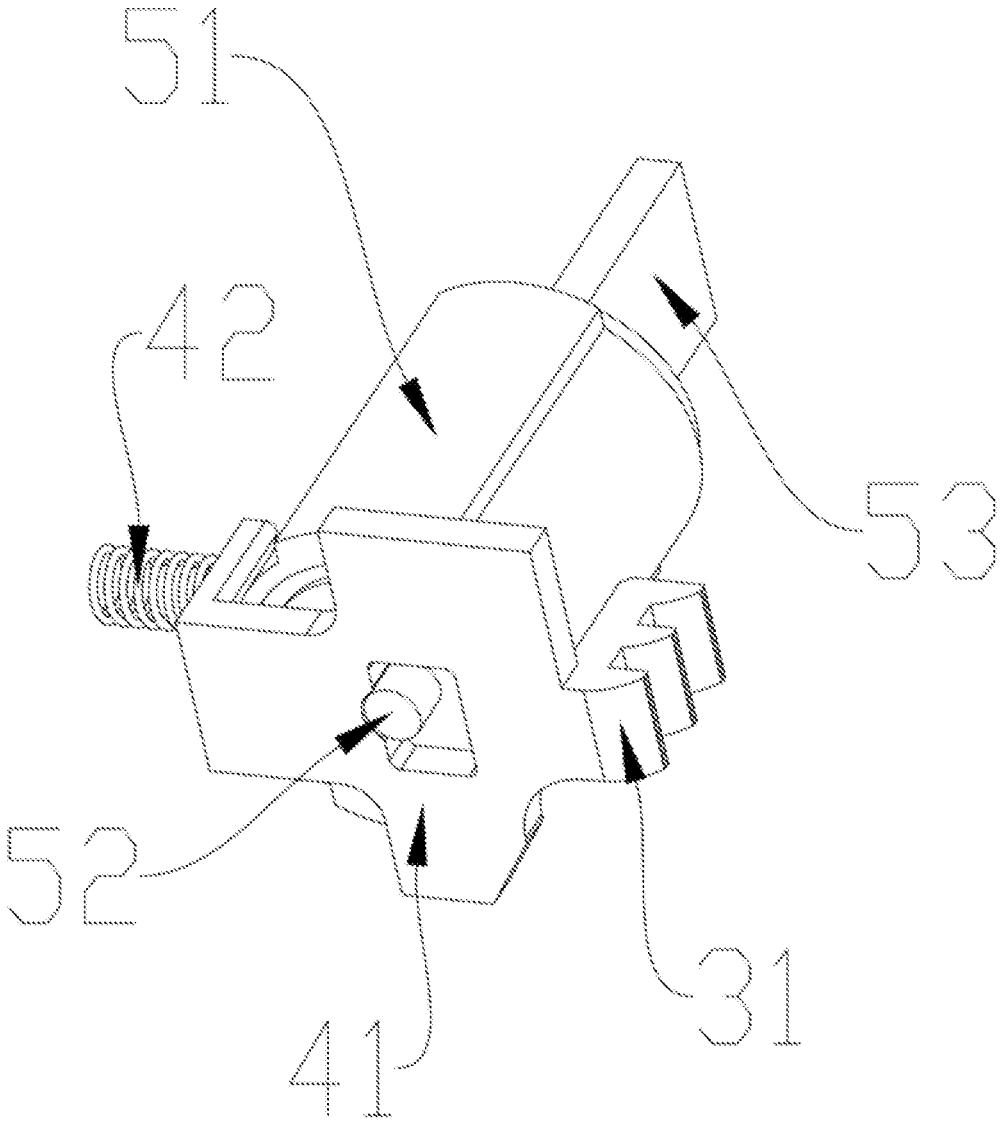
FIG. 5 is a schematic structural diagram of a mechanical unlocking device of the present disclosure.
Figure 6:
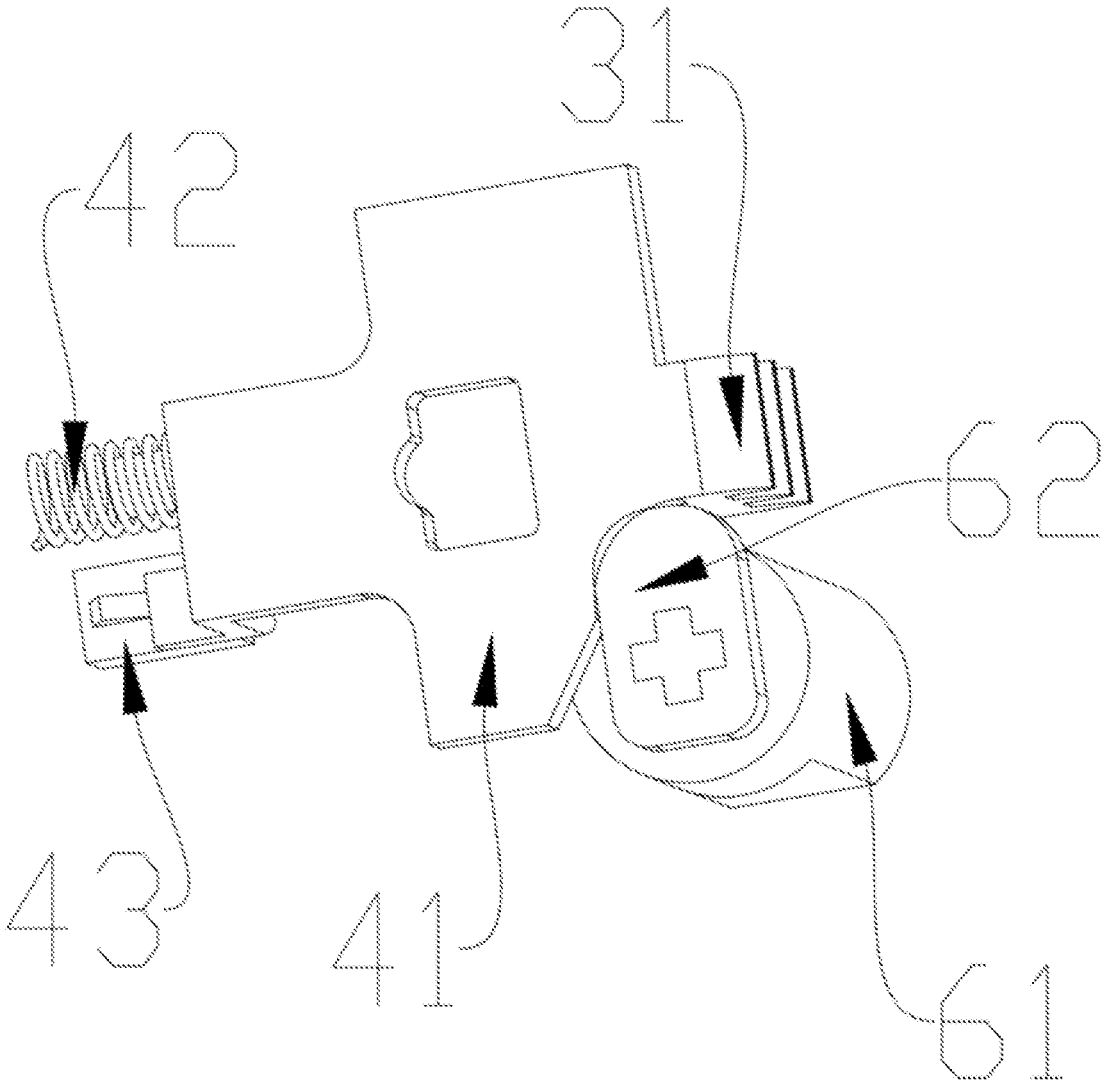
FIG. 6 is a schematic structural diagram of an electric unlocking device of the present disclosure.
Figure 7:
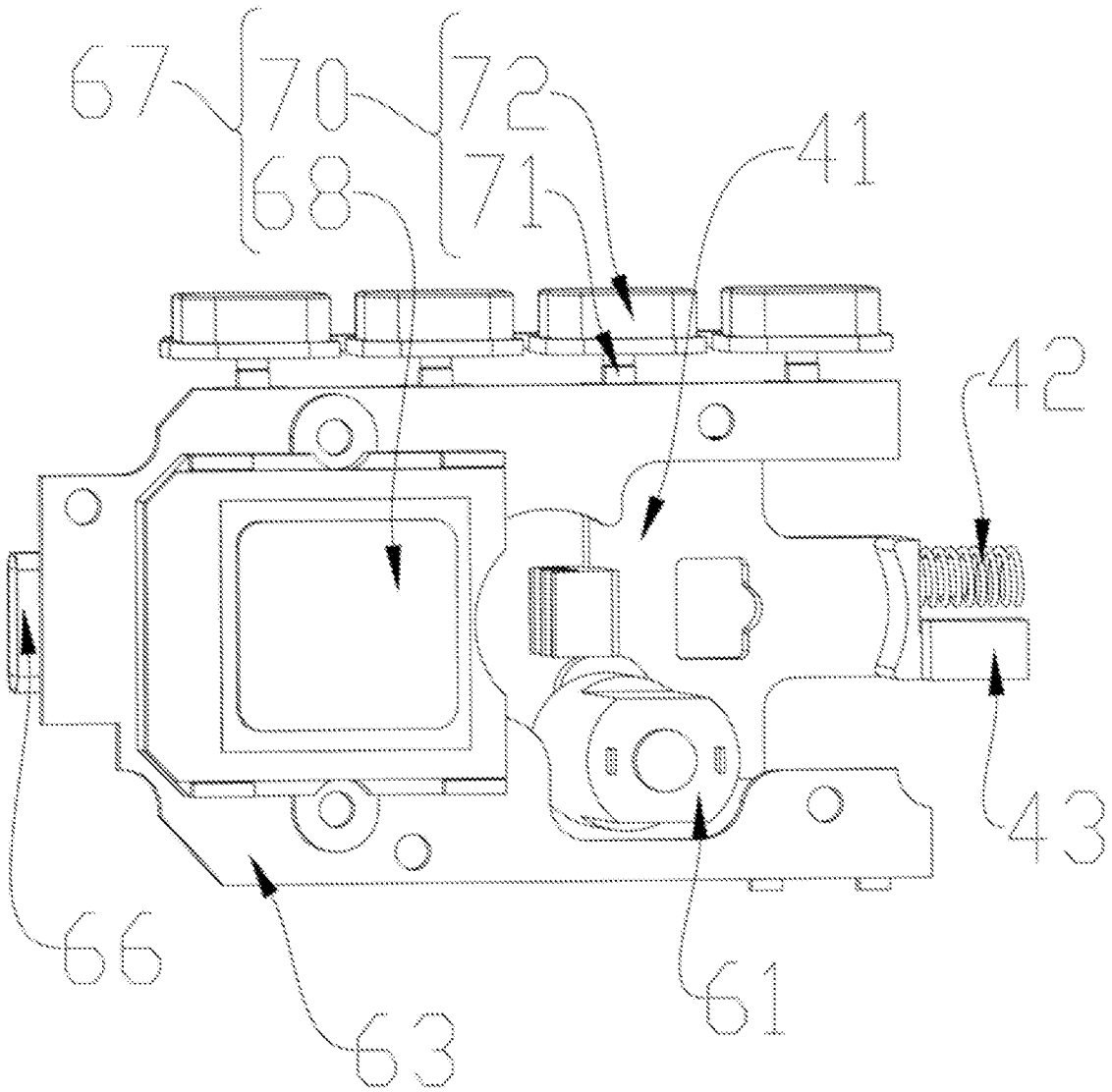
FIG. 7 is a schematic structural diagram of a recognition assembly the present disclosure.
Figure 8:
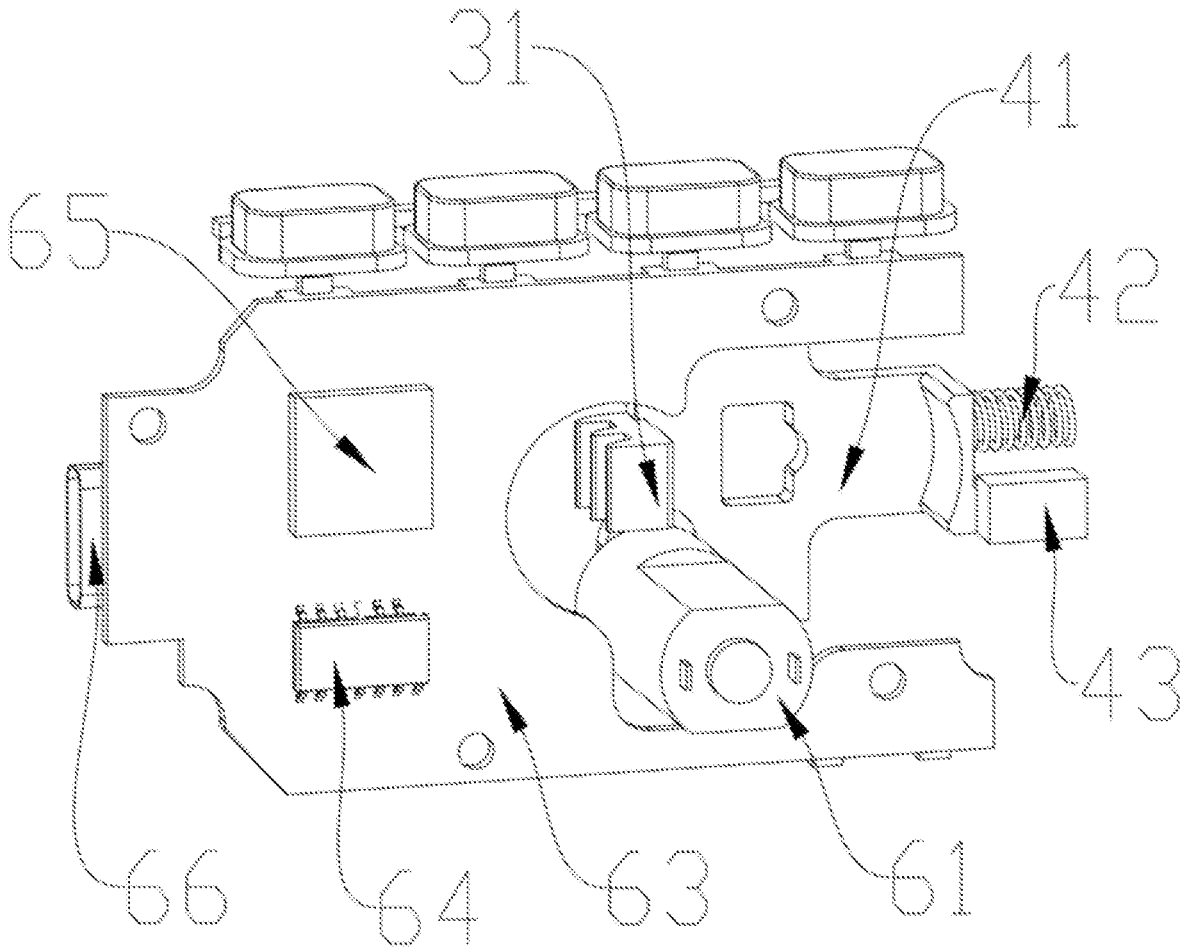
FIG. 8 is a schematic structural diagram of a circuit board of the present disclosure.
Figure 9:
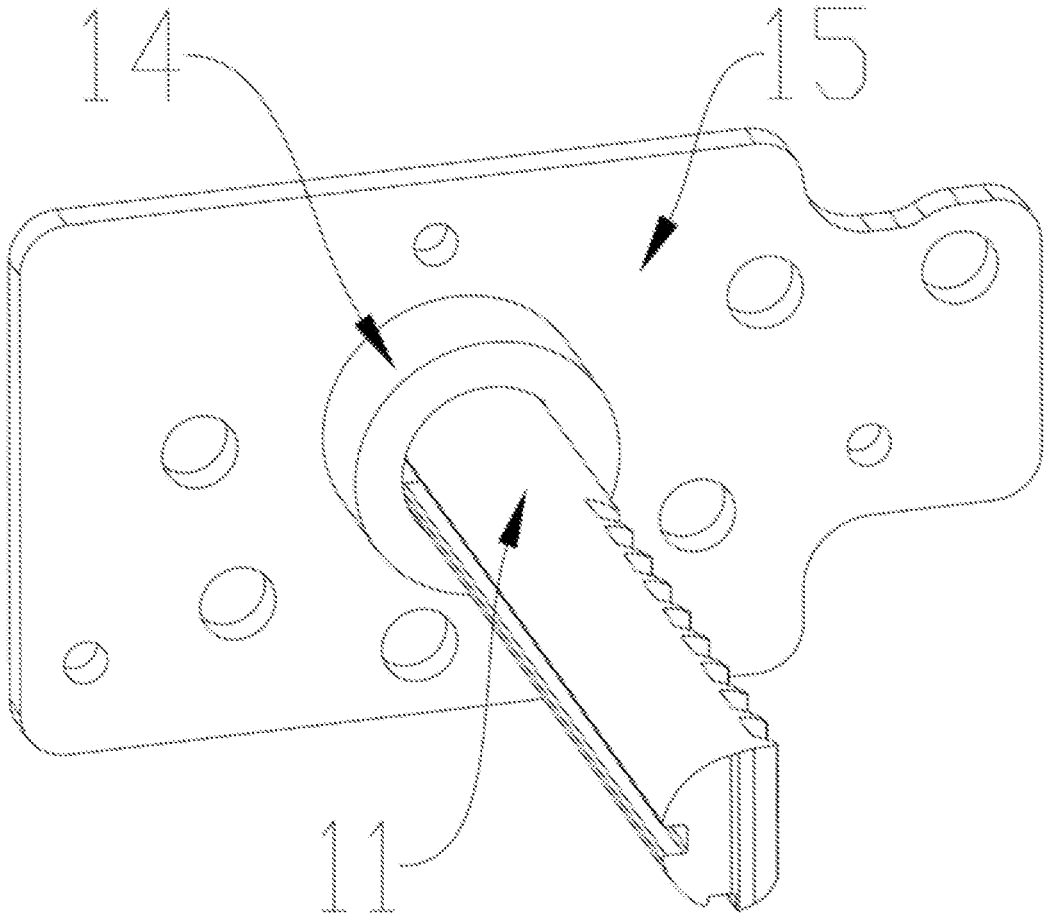
FIG. 9 is a schematic structural diagram of a fixing block of the present disclosure.
Figure 10:
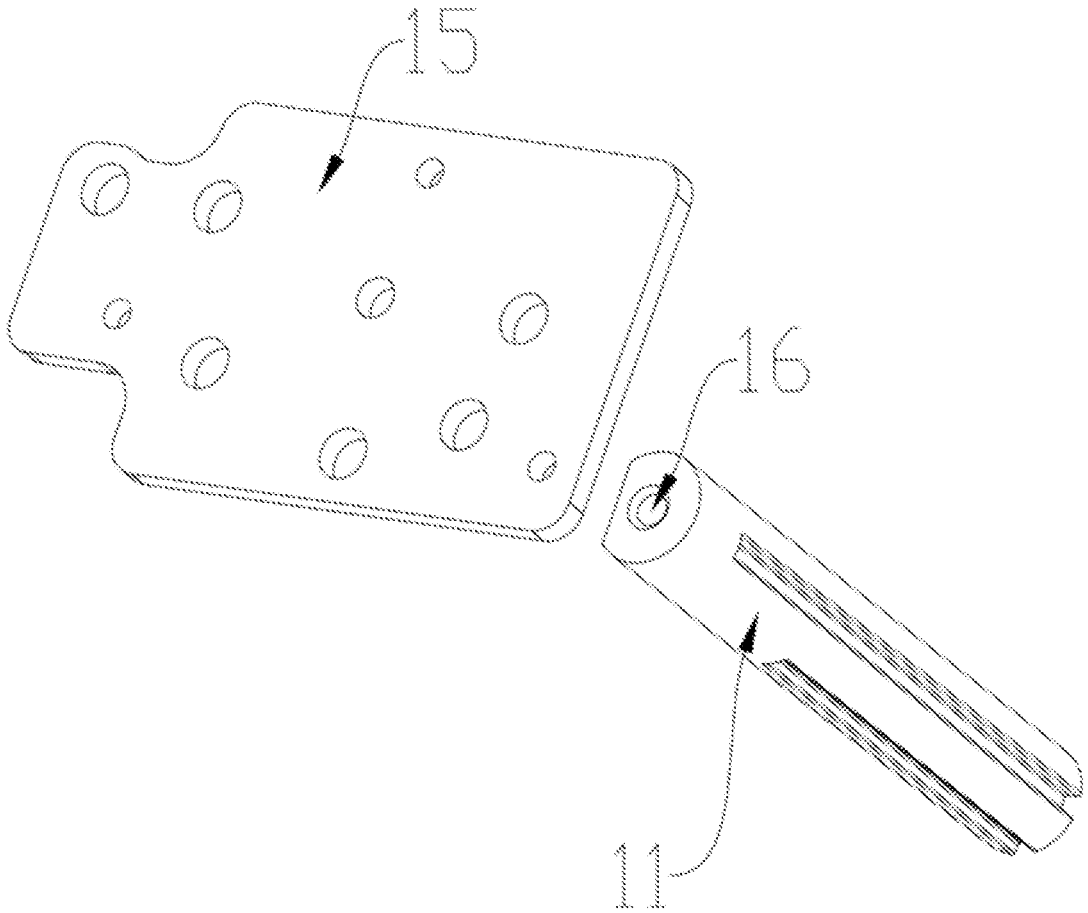
FIG. 10 is a schematic structural diagram of a position of a threaded hole of the present invention.
Figure 11:
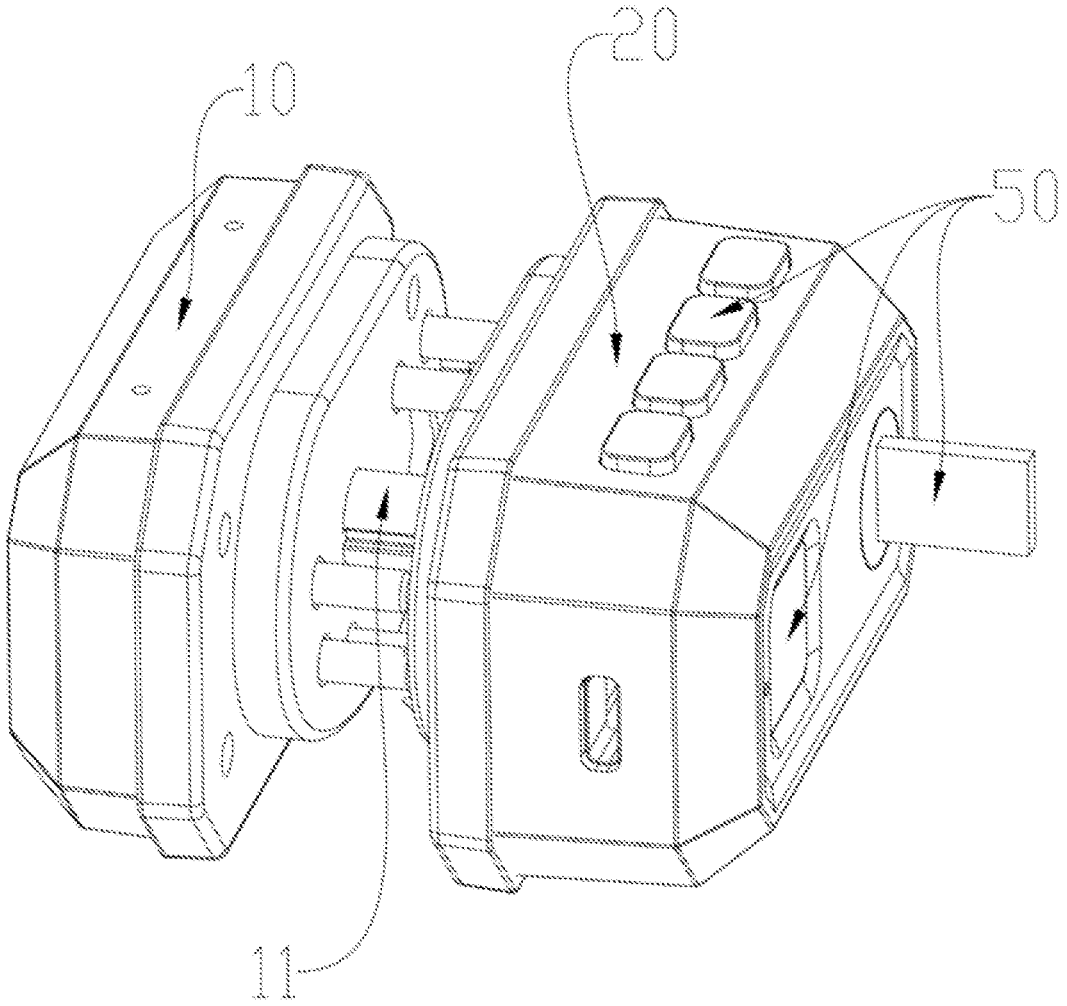
FIG. 11 is a schematic diagram of an entire structure of the present disclosure.
Figure 12:
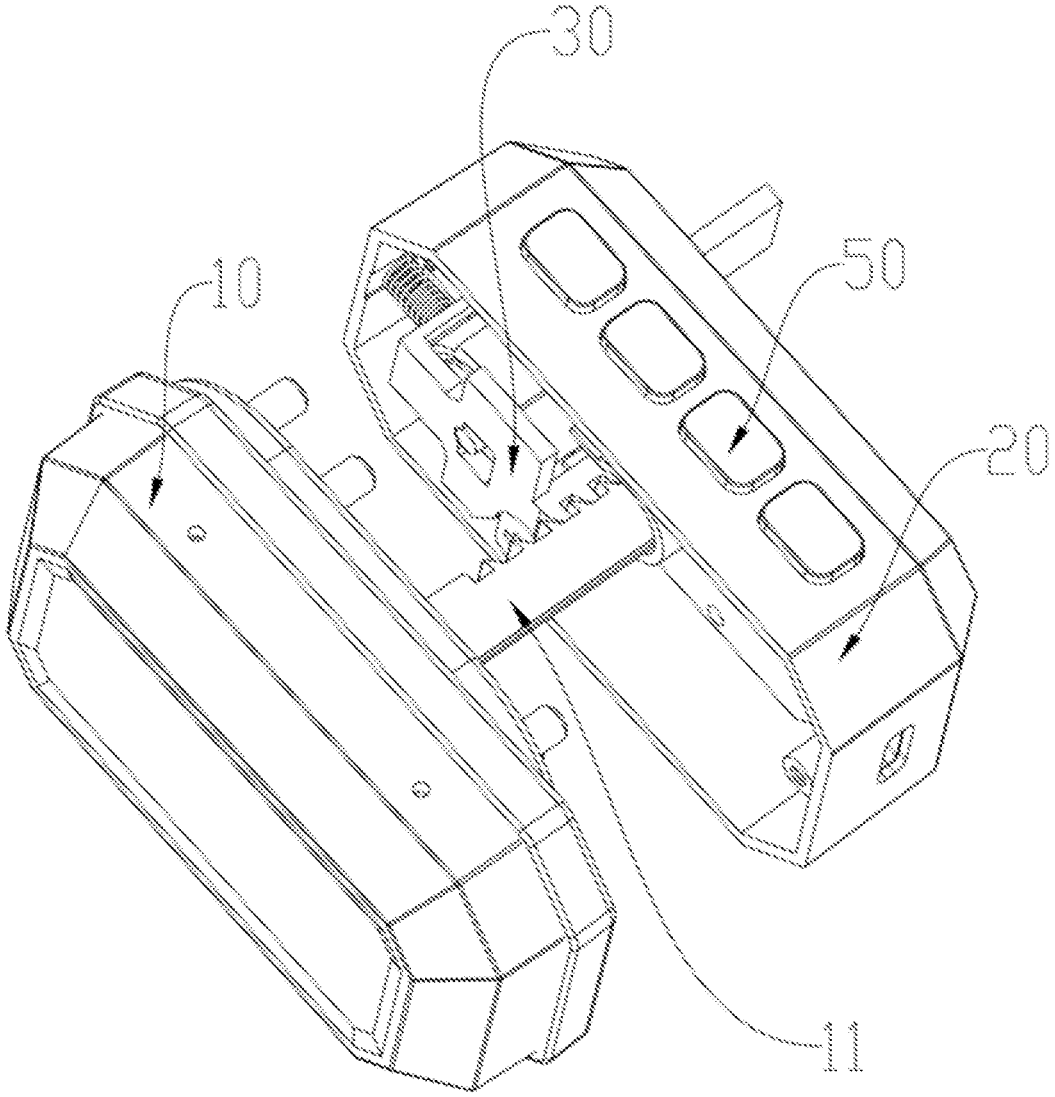
FIG. 12 is a schematic structural diagram of a locking device of the present disclosure.
Figure 13:
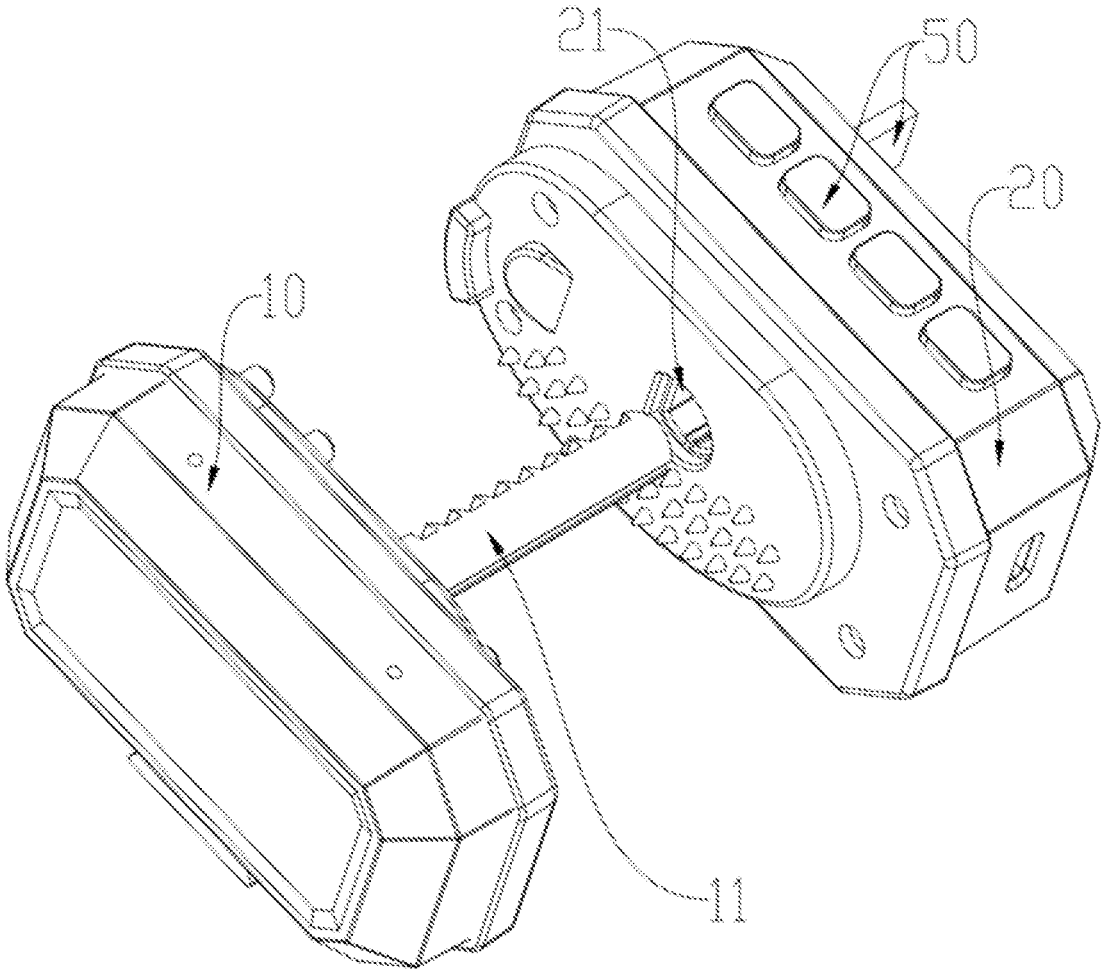
FIG. 13 is a schematic structural diagram of a state of preparation for locking and insertion of the present disclosure.
Figure 14:
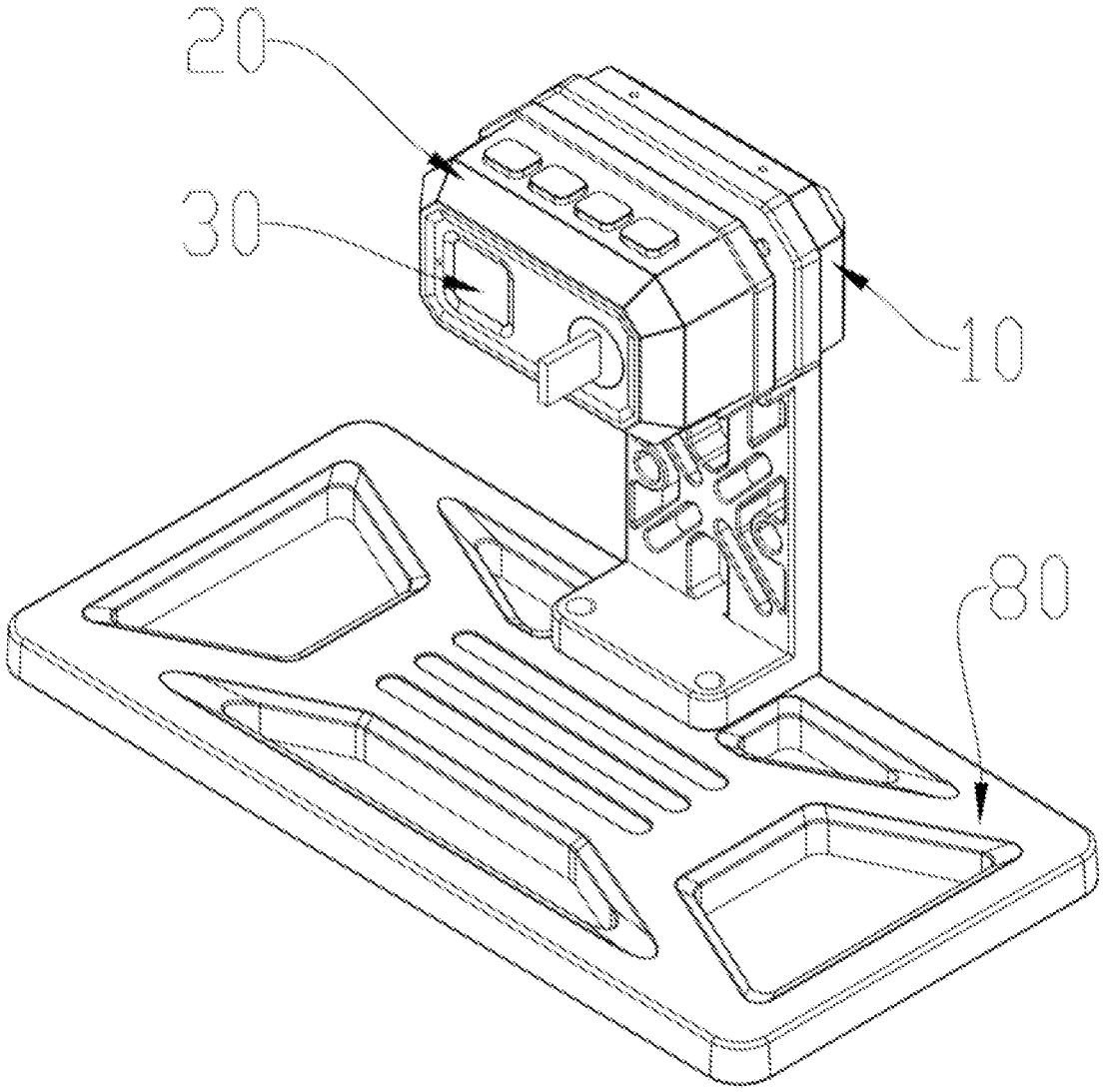
FIG. 14 is a schematic structural diagram I of a mechanical lock of the present disclosure.
Figure 15:
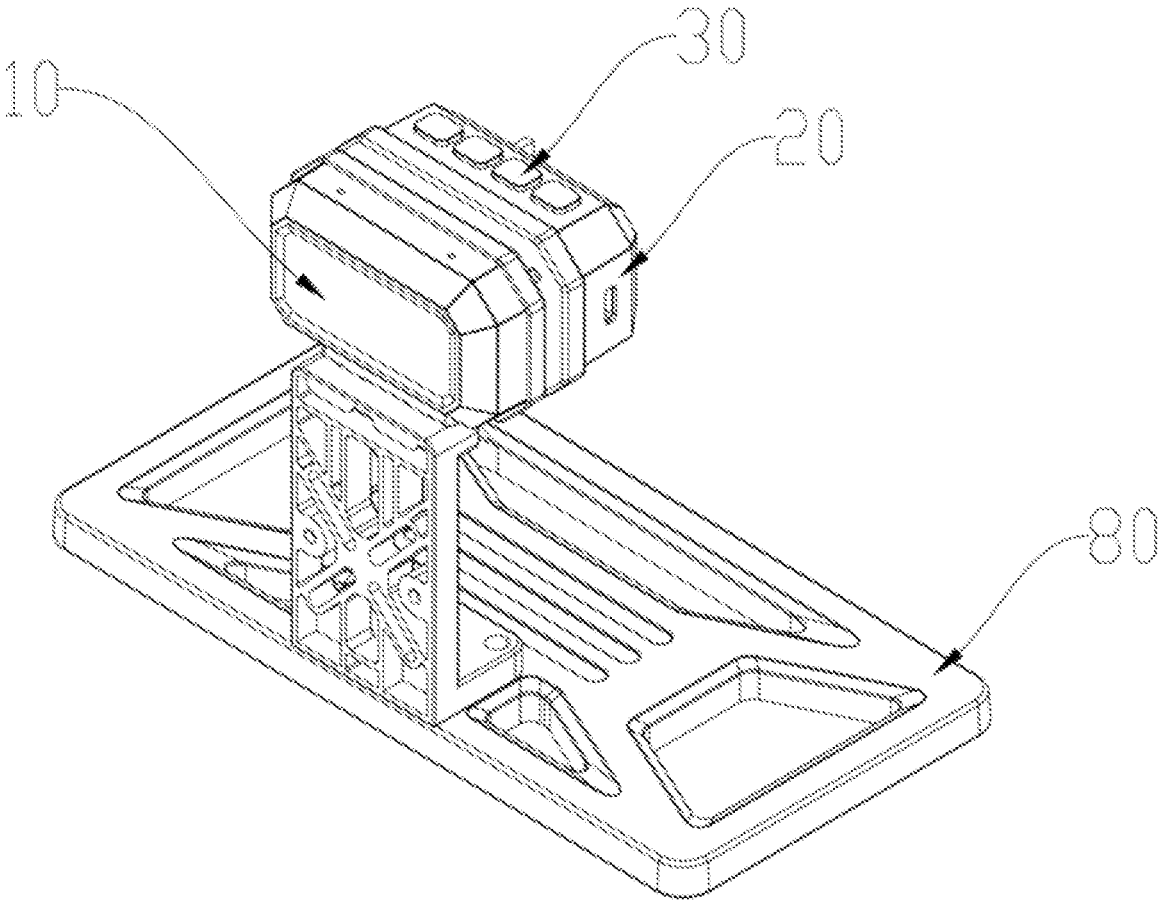
FIG. 15 is a schematic structural diagram II of a mechanical lock of the present disclosure.
Figure 16:
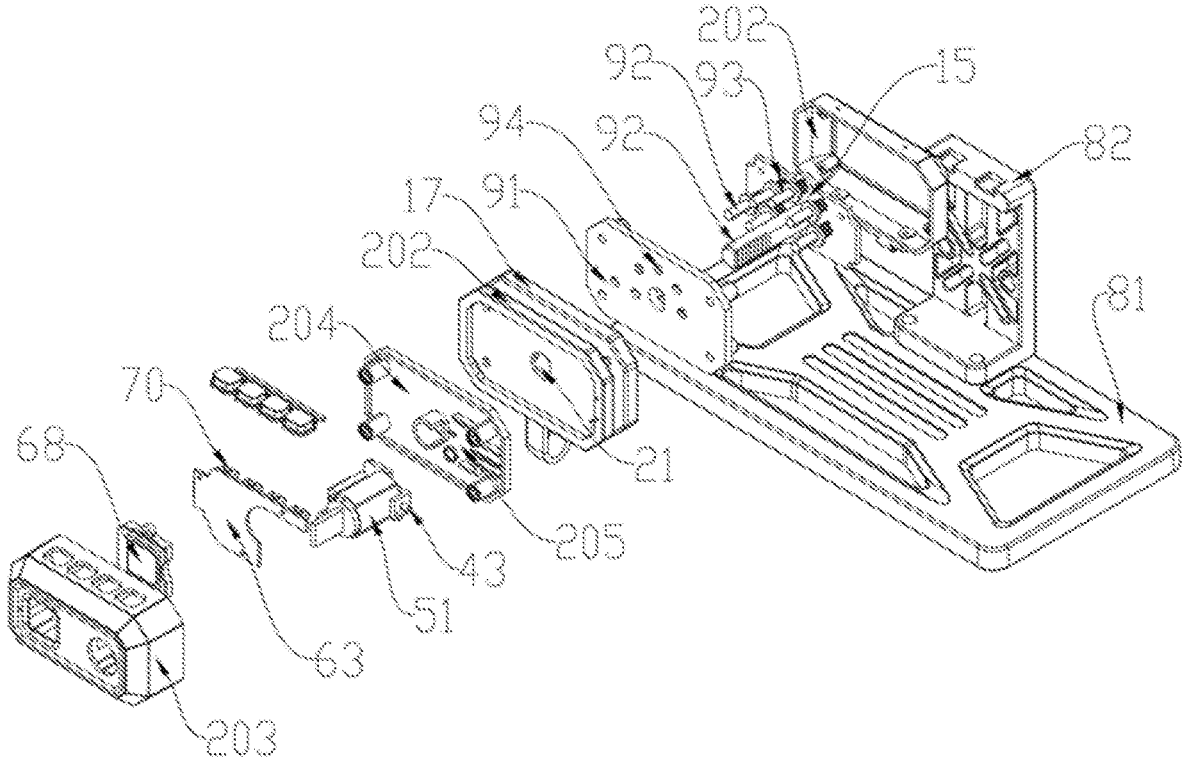
FIG. 16 is a schematic exploded structural diagram I of a mechanical lock of the present disclosure.
Figure 17:
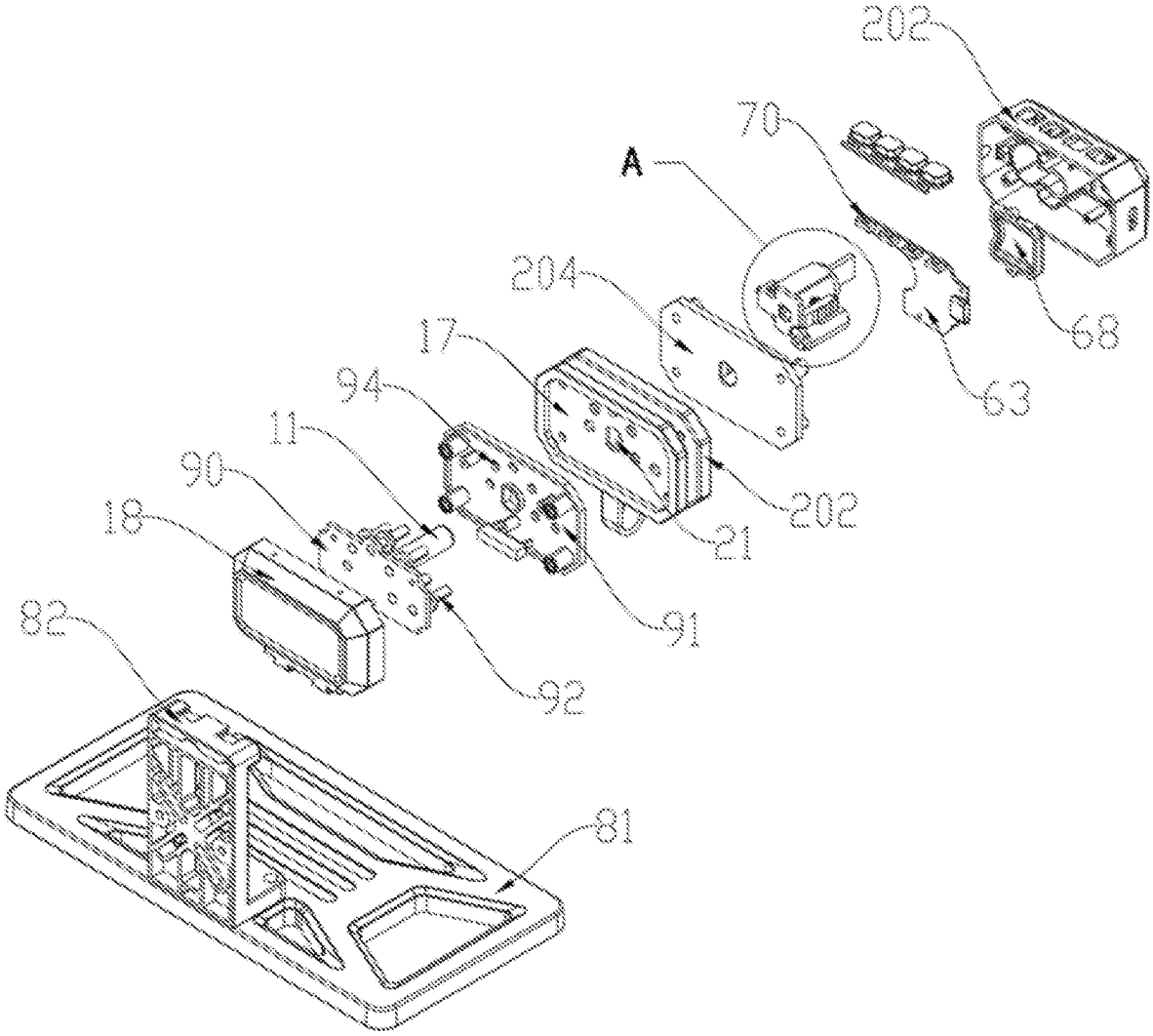
FIG. 17 is a schematic exploded structural diagram II of a mechanical lock of the present disclosure.
Figure 18:
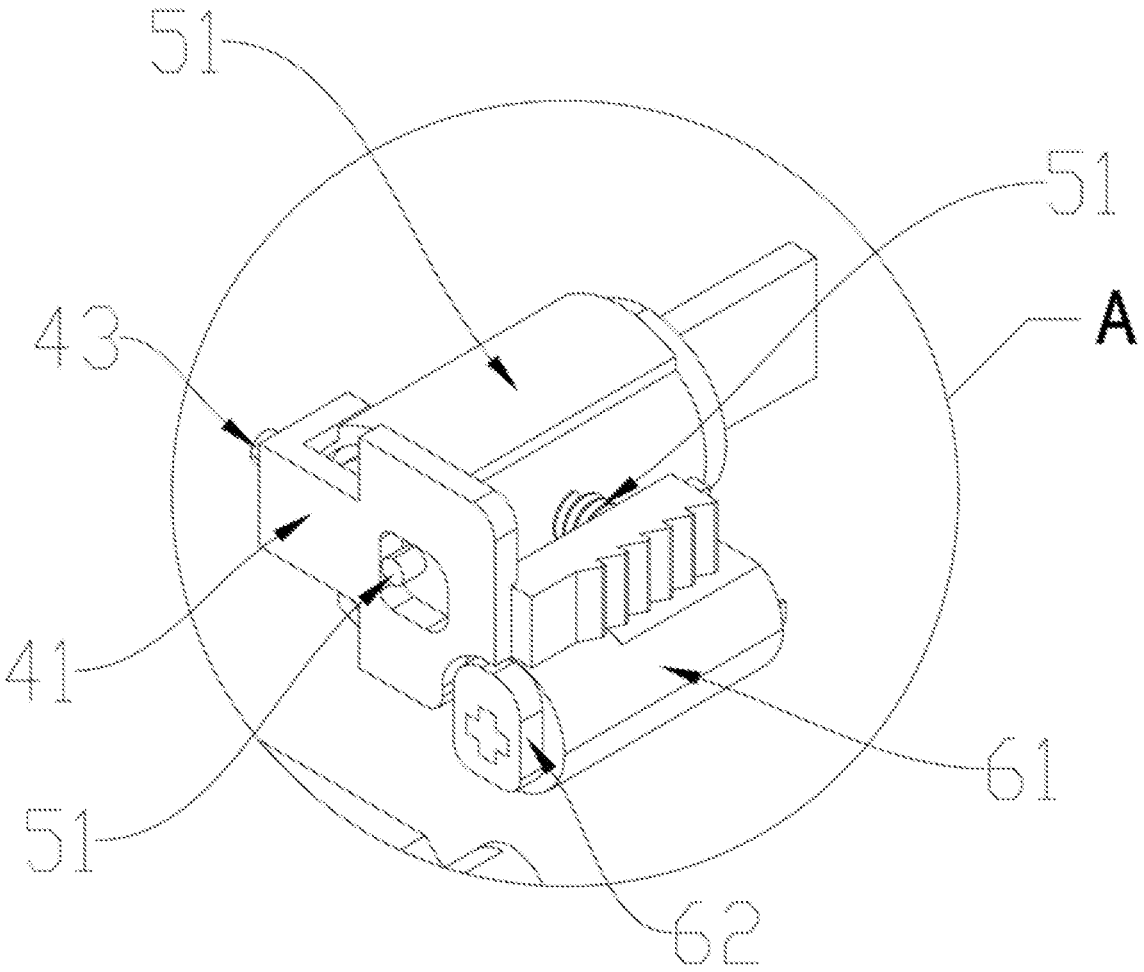
FIG. 18 is a partially enlarged diagram of a portion A of FIG. 17 of the present disclosure.

Referring to FIG. 1 to FIG. 18, in an embodiment of the present disclosure, a lock structure with improved safety includes a fixed cavity 10 and an unlocking cavity 20 which are spaced apart from each other by a certain space and are in locked connection. The fixed cavity 10 is provided with a lock beam 11 extending out of the fixed cavity 10. The unlocking cavity 20 is provided with a lockhole 21 for the lock beam 11 to be threaded in, and a locking device 30 for locking the lock beam 11. The lock beam 11 is threaded into a trigger position of a gun and then into the lockhole 21, and is locked by the locking device 30, so that the gun is locked in the space after the fixed cavity 10 and the unlocking cavity 20 are in locked connection. An inner wall of the lockhole 21 extends into the unlocking cavity 20 to form a lockhole ring 22. A convex rib 25 is arranged on an inner wall of the lockhole ring 22. AA groove 13 is formed in an outer wall of the lock beam 11. The lock beam 11 is threaded into the lockhole 21, and moves in the lockhole ring 22. The convex rib 25 and the groove 13 are connected with each other in an embedded manner, so that the lock beam 11 is kept stable in the lockhole ring 22.

Specifically, as for a special instrument such as a gun, it is necessary to be very careful in its storage and use to avoid the gun from being stolen or misused. It is also a very effective storage measure to lock the gun to prevent it from being used by unauthorized persons. The gun also needs to be disassembled and maintained frequently after it has not been used for a certain period of time, so a lock certainly need to be often unlocked and locked. Therefore, it is also necessary to prolong a repeated service life of the lock. In addition, it is also very important to prevent a lock from being prized up by violence. Since the lock beam 11 needs to pass through the lockhole 21 to be in locked connection with the locking device 30, cooperation between the lock beam 11 and the lockhole 21 is very important. It is necessary to ensure that the lock beam 11 can be threaded in and out smoothly, and also to ensure that the lock beam 11 is in a stable state in the lockhole 21, so as to prevent the lock beam 11 from being prized up by violence in the lockhole 21. Setting the lockhole ring 22 in the lockhole 21 can better stabilize the lock beam 11. In addition, the convex rib 25 is also arranged on the lockhole ring 22, and the groove 13 corresponding to the convex rib 25 is formed in the lock beam 11, so that the lock beam 11 can be smoother and more stable when it is threaded into the lockhole ring 22. Thus, a service life of the lock is effectively prolonged; a risk that the lock beam 11 is prized up by violence in the lockhole ring 22 is also avoided; the safety of using a gun is improved; and a situation of being stolen or misused is reduced.

One part of a sector ring of the lockhole ring 22 is formed into a long sector ring 23, and the other part of the sector ring of the lockhole ring 22 is formed into a short sector ring 24. A distance between a top of the long sector ring 23 and a plane of the lockhole 21 is set to be a first length. A distance between a top of the short sector ring 24 and the plane of the lockhole 21 is set to be a second length. The first length is greater than the second length. A notch 28 is formed in the short sector ring 24 of the lockhole ring 22. The locking device 30 is in locked connection with the lock beam 11 through the notch 28.

Specifically, to further improve stability of connection between the lock beam 11 and the lockhole 21, the lockhole ring 22 is particularly lengthened. In addition, the lockhole ring 22 is divided into two sector rings with different lengths. The long sector ring 23 is longer than the short sector ring 24, so that one notch 28 can be formed in the short sector ring 24, which facilitates the locking device 30 to extend into the lockhole ring 22 through the notch 28. Therefore, the spring bolt 31 inside the locking device 30 can be in locked connection with the lock beam 11 to complete locking cooperation of the lock, to form a locked structure for the gun.

Two groups of convex ribs 25 are arranged on the inner wall of the lockhole ring 22. Two groups of grooves 13 are arranged on the inner wall of the lock beam 11. The two groups of convex ribs 25 and the two groups of grooves 13 are respectively connected with each other in the embedded manner. Lengths of one group of convex ribs 25 in an axial direction of the lockhole ring 22 are equal to the first length; and lengths of the other group of convex ribs 25 in the axial direction of the lockhole ring 22 are equal to the second length.

Specifically, after the two groups of convex ribs 25 and the two groups of grooves 13 are connected in the embedded manner respectively, the lock beam 11 can move in the lockhole ring 22 more stably, and a difficulty in picking a lock can be increased, and the safety is further improved. The lengths of the two groups of convex ribs 25 in the axial direction of the lockhole ring 22 are respectively equal to the lengths of the long sector ring 23 and the short sector ring 24, thereby playing a protection role to a maximum extent. It can be understood that more than two groups of convex ribs 25 and grooves 13 can also be set according to a need. In addition, the lengths of the two groups of grooves 13 on the lock beam 11 in the axial direction of the lock beam 11 can also be different. The long groove 13 keeps extending to the lock beam 11 located in the fixed cavity 10, and positions, which are used for fixing the lock beam 11, on the fixed cavity 10 or a housing of the fixed cavity 10 are or is also provided with convex ribs 25 corresponding to the grooves 13, thereby making the connection of the lock beam 11 inside the fixed cavity 10 more stable.

The locking device 30 is provided with a spring bolt 31, a spring bolt rack 32, a sliding block 41, a push spring 42 and an unlocking device 50. The spring bolt rack 32 is located on one side of the spring bolt 31 opposite to the lock beam 11. The lock beam 11 is provided with a lock beam rack 12. The lock beam rack 12 and the spring bolt rack 32 are clamped with each other to form locked connection. The unlocking device 50 drives the sliding block 41 to move, thereby driving the spring bolt rack 32 to be separated from the lock beam rack 12 to relieve the locked connection. The push spring 42 is used for driving the sliding block 41 to reversely move and be reset, thereby driving the spring bolt rack 32 to be in locked connection with the lock beam rack 12 again.

Specifically, the spring bolt rack 32 and the lock beam rack 12 each have a plane and a slope. When the lock beam rack 12 enters the lockhole ring 22 through the lockhole 21, the slope of the lock beam rack 12 and the slope of the spring bolt rack 32 are in contact with each other, so that the two slopes interact with each other to achieve sliding; the spring bolt rack 32 drives the spring bolt 31 and the sliding block 41 to move away from the lock beam 11, so that the spring bolt rack 32 and the lock beam rack 12 are embedded with each other; and the plane of the lock beam rack 12 and the plane of the spring bolt rack 32 are in contact with each other. Under a reverse push acting force of the push spring 42, the sliding block 41 moves reversely to form the locked connection between the spring bolt rack 32 and the lock beam rack 12.

The spring bolt rack 32 has a topland 33, a root surface 34 and a bottom land 35. A distance between the topland 33 and the root surface 34 is set to be a first thickness. A distance between the topland 33 and the bottom land 35 is set to be a second thickness. A numerical value of the first thickness is 0.4 to 0.6 times that of the second thickness.

Specifically, to make the spring bolt rack 32 firmer and prevent it from being prized up with a tool such as a steel needle, the spring bolt rack 32 is particularly thickened. However, strength of the spring bolt 31 itself will be affected if only the spring bolt rack 32 is thickened, which easily causes that a body of the spring bolt 31 is directly broken. After technician's research and comparison, it is finally found that when the numerical value of the first thickness of the spring bolt rack 32 is 0.4 to 0.6 times of the numerical value of the second thickness, the firmness of the spring bolt rack 32 and the body of the spring bolt 31 are relatively balanced, which can improve the overall firmness.

The unlocking device 50 is provided with a mechanical lock cylinder 51, a mechanical rotating shaft 52 and a mechanical key 53. One end of the mechanical rotating shaft 52 is fixedly connected to a rotating component of the mechanical lock cylinder 51. The other end of the mechanical rotating shaft 52 abuts against the sliding block 41. The mechanical key 53 is inserted into the mechanical lock cylinder 51 to enable the rotating component to rotate, thereby driving the mechanical rotating shaft 52 to rotate; and the mechanical rotating shaft 52 rotates to drive the sliding block 41, abutting against the mechanical rotating shaft, to move, thereby relieving the locked connection.

Specifically, the mechanical lock cylinder 51, the mechanical rotating shaft 52 and the mechanical key 53 here may be universal products in the prior art. During production, corresponding products that satisfy the specifications are directly purchased. To better cooperate with the mechanical rotating shaft 52 in the prior art, special shapes or structures can be arranged at abutting positions of the sliding block 41 and the mechanical rotating shaft 52, so that the mechanical rotating shaft 52 better drives the sliding block 41 to move to make the unlocking process smoother.

The unlocking device 50 is provided with a motor 61, a cam 62, a circuit board 63, a processor chip 64, a battery 65, a power data interface 66 and a recognition assembly 67. One end of the cam 62 is fixedly connected to a drive shaft of the motor 61, and the other end of the cam 62 abuts against the sliding block 41. The motor 61, the processor chip 64, the battery 65, the power data interface 66 and the recognition assembly 67 are electrically connected to the circuit board 63 respectively. The processor chip 64 is used for driving, according to a recognition result of the recognition assembly 67, the motor 61 to rotate, and driving the cam 62 to rotate; and the cam 62 rotates to drive the sliding block 41, abutting against the cam, to move, thereby relieving the locked connection.

Specifically, to add use scenarios and universality of the lock, the electric unlocking device 50 is further provided. Based on the recognition result of the recognition assembly 67, the processor chip 64 can compare whether the recognition result has a preset permission for unlocking. If the recognition result has an unlocking permission, the processor chip 64 sends a signal to the motor 61. After receiving the signal, the motor 61 starts to rotate, thereby driving the cam 62 to rotate synchronously. The cam 62 drives the sliding block 41 to move, thereby relieving the locked connection and achieving an unlocked state. The power supply data interface 66 can charge the battery 65, or directly drive the motor 61 to run, or may interact with a remote management system, thereby feeding back a state of a current lock to the remote management system, or receiving an instruction of the remote management system to directly unlock the lock. This function is particularly applicable to centralized management of guns in a collective place. After unlocking is completed, the processor chip 64 controls the motor 61 to stop running, and the sliding block 41 returns to an original position under an elasticity of the push spring 42. When the processor chip 64 drives the motor 61 to rotate for unlocking, a position detection switch 43 can also be arranged at a tail end at which the sliding block 41 moves.

When the sliding block 41 abuts against the position detection switch 43, it indicates that the sliding block 41 has moved to the end position at this time and the spring bolt rack 32 has been separated from the lock beam rack 12. The lock has been unlocked. At this time, the position detection switch 43 will feed back a signal to the processor chip 64 to stop the motor 61 from continuously rotating, and the sliding block 41 returns to the original position under the elasticity of the push spring 42. In addition, a detection procedure can also be arranged inside the processor chip 64. When it is detected that a running current of the motor 61 increases, it indicates that the current sliding block 41 has moved to the end position. At this time, since the sliding block 41 cannot continue to move, the motor 61 stops rotating at an on-position. Thus, the current increases. Therefore, the processor chip 64 can stop driving the motor 61, so that the sliding block 41 returns to the original position under the elasticity of the push spring 42. Or, the processor chip 64 may reversely drive the motor 61, thereby driving the sliding block 41 to reversely move to the original position.

The recognition assembly 67 is provided with a fingerprint recognition module 68. The fingerprint recognition module 68 is electrically connected with the circuit board 63. The fingerprint recognition module 68 is exposed out of a housing of the unlocking cavity 20, so as to facilitate fingerprint recognition.

The recognition assembly 67 is provided with a button recognition module. The button recognition module 70 includes a contact button 71 and a press housing 72. The contact button 71 is electrically connected with the circuit board 63. One end of the press housing 72 abuts against the contact button 71, and the other end of the press housing 72 is exposed out of the housing of the unlocking cavity 20, thereby facilitating pressing.

Specifically, to further improve the universality of the lock and the convenience of unlocking, two recognition manners are set. One manner is to directly recognize a fingerprint of a user by means of the fingerprint recognition module 68, which is fast in unlocking and very safe. However, when the skin of the hand of the user is damaged or stained, it is not easy for the fingerprint recognition module 68 to achieve correct recognition. Therefore, the button recognition module 70 is also designed. The lock can be unlocked immediately after a preset numerical value is typed in by means of directly pressing the press housing 72

A fixing ring 14 and a fixing block 15 which are fixedly connected with each other are arranged inside the fixed cavity 10. The fixing block 15 is fixedly connected inside the fixed cavity 10. The other end of the lock beam 11 relative to the lock beam rack 12 is in press-fit with the fixing ring 14, so that the lock beam 11 is fixed in the fixing ring 14. A threaded hole 16 is formed in an end socket of one end of the lock beam 11 pressed into the fixing ring 14, and a pin hole is formed in a position, corresponding to the threaded hole 16, on the fixing block 15. The lock beam 11 is in bolted connection with the fixing block 15 through the threaded hole 16.

Specifically, the lock beam 11 adopts a separable design, which facilitates replacement in subsequent use. The lock beam 11 is fixed by using the fixing block 15 and the fixing ring 14, so that the lock beam 11 is firmly fixed on the fixed cavity 10. One end of the lock beam 11 clamped into the fixing ring 14 is provided with the threaded hole 16, which further fixes fixing block 15 and the lock beam 11 through a bolt.

During use, recognition setting is first performed on the lock. That is, a fingerprint and a use password of a user are set. The lock is then unlocked, so that the lock beam 11 is withdrawn from the lockhole 21 to separate the fixed cavity 10 from the unlocking cavity 20. The fixed cavity 10 is aligned with the trigger position of the gun, and the lock beam 11 passes through the trigger. Furthermore, some supporting pillars on the fixed cavity 10 are just locked at corresponding positions of the trigger. One side of the lockhole 21 of the unlocking cavity 20 is also aligned with the trigger position of the gun, so that the lock beam 11 just passes through the lockhole 21 and enters the unlocking cavity 20. Furthermore, a certain thrust is applied, so that the lock beam rack 12 and the spring bolt rack 32 interact with each other. Therefore, the spring bolt rack 32 leaves to reserve a certain space. The lock beam 11 enters the embedded position of the spring bolt rack 32. Under the action of the push spring 42, the spring bolt rack 32 is clamped to the lock beam rack 12 again to achieve the locked connection. That is, the fixed cavity 10 and the unlocking cavity 20 are locked at the trigger position of the gun, so that the gun cannot be used and is prevented from being stolen or misused.

When the gun needs to be used, the locking device 30 is unlocked by means of the mechanical key 53, fingerprint recognition or button recognition, so that the spring bolt rack 32 of the locking device 30 moves back a certain distance and is separated from the lock beam rack 12. The lock beam 11 can be withdrawn from the unlocking cavity 20 to unlock the lock, and the gun can be used.

The present disclosure further provides a gun lock, including: a support assembly 80, wherein the support assembly 80 includes a first fixed frame 81 and a second fixed frame 82; the first fixed frame 81 is used for fixing this device in a gun safe, a security booth, an airport, a bank and the like; the second fixed frame 82 is connected and fixed to the first fixed frame 81 and a fixed cavity 10; the fixed cavity 10, wherein the fixed cavity 10 is fixedly connected with the support assembly 80, and the fixed cavity 10 is provided with a lock beam 11; an unlocking cavity 20, wherein the unlocking cavity 20 is flexibly connected with the fixed cavity 10 to prevent the lock from being lost, and the unlocking cavity 20 is provided with a lockhole 21; and a locking device 30, wherein the locking device 30 is arranged in the unlocking cavity 20, wherein the lock beam 11 is used for being fixedly clamped at a trigger of a gun, and the lock beam 11 is of a ratchet bar structure. The lock beam 11 consequently extends into the lockhole 21 and the locking device 30. The ratchet bar structure can provide sliding guidance for the lock beam. When the lock beam 11 is reversely pulled out of the lockhole 21 by a force, the ratchet bar structure can be effectively clamped with the locking device 30 to prevent the lock beam 11 from being separated from the locking device 30.

More specifically, the fixed cavity 10 further includes a first front shell 17, a first rear shell 18 and a push assembly 90. The first front shell 17 is flexibly connected with the unlocking cavity 20, and the first front shell 17 is fixedly connected with the first rear shell 18 to form a first cavity. The push assembly 90 is arranged in the first cavity. The push assembly 90 is used for pushing the gun to make the gun tightly abut against a side wall of the unlocking cavity 20 and prevent the gun from being loosened.

More specifically, the push assembly 90 includes a first fixed plate 91, a fixing block 15, a push post 92 and a first spring 93. Both the first fixed plate 91 and the fixing block 15 are arranged in the first cavity. Both the first front shell 17 and the first fixed plate 91 are provided with through holes 94. The lock beam 11 is arranged on the fixing block 15. The push post 92 abuts against the fixed cavity 10 after passing through the through holes 94. The first spring 93 abuts against the fixing block 15 and the push post 92 respectively.

More specifically, the unlocking cavity 20 further includes a second front shell 202, a second rear shell 203 and a second fixed plate 204. The second front shell 202 is flexibly connected with the fixed cavity 10. The second front shell 202 is fixedly connected with the second rear shell 203 to form a second cavity. Both the second fixed plate 204 and the locking device 30 are arranged in the second cavity. The second fixed plate 204 is provided with a sliding chute 205. The locking device 30 includes a sliding block 41. The sliding block 41 is arranged in the sliding chute 205, and moves in the sliding chute 205 to be intermittently clamped to and separated from the lock beam 11. The sliding block 41 is also of a ratchet bar structure and is matched with the lock beam 11, so as to enlarge an area of engagement and increase an engaging force.

In the present disclosure, two different locking structures 4 are designed. One locking structure is a mechanical lock cylinder 51. The mechanical lock cylinder 51 is provided with a mechanical rotating shaft 52 at an eccentric position. The mechanical rotating shaft 52 rotates with the mechanical lock cylinder 51, so as to drive the sliding block 41 to move in the sliding chute 205.

More specifically, the sliding block 41 is provided with a push spring 42. The push spring 42 abuts against the sliding block 41 and the mechanical lock cylinder 51 respectively to drive the sliding block 41 to be clamped with the lock beam 11, and to drive, after the sliding block 41 slides to unlock the lock, the sliding block to be reset.

The second structure of the locking device 30 includes a circuit board 63 and a motor 61. The circuit board 63 is electrically connected with the motor 61. The motor 61 is provided with a cam 62. The cam 62 rotates with the motor 61, and the cam 62 abuts against the sliding block 41, so as to drive the sliding block 41 to move in the sliding chute 205.

More specifically, the sliding block 41 is provided with a position detection switch 43. The position detection switch 43 is in signal connection with the motor 61. The position detection switch 43 is triggered intermittently with movement of the sliding block 41 to control the motor 61 to anticlockwise rotate and be reset.

There are also two operation forms of the circuit board 63 in the present disclosure. One operation form is a fingerprint recognition module 68. The fingerprint recognition module 68 is electrically connected with the circuit board 63. The fingerprint recognition module 68 provides an unlocking signal to the circuit board 63, and the circuit board 63 controls the motor 61 to rotate to achieve unlocking.

The second operation form of the circuit board 63 is a button recognition module 70. The button recognition module 70 is electrically connected with the circuit board 63. The button recognition module 70 provides an unlocking signal to the circuit board 63, and the circuit board 63 controls the motor 61 to rotate to achieve unlocking.

Any one of the two structures of each of the locking device 30 and the circuit board 63 may be set, or the two structures may be simultaneously set. In this embodiment, the above four structures are simultaneously set. The sliding block 41 may be driven by the mechanical rotating shaft 52 of the mechanical lock cylinder 51 and the cam 62 of the motor 61, so that unlocking can be achieved by using a fingerprint and a password, as well as by using a key. Different unlocking forms provide different options, which improves adaptability of a product.

During use, when the gun and the lock are locked, the trigger of the gun is sleeved to the lock beam 11, and the lock beam 11 then extends into the lockhole 21. The ratchet bar structure of the lock beam 11 pushes the sliding block 41 to slide. The sliding block 41 is reset under the pushing of the push spring 42 and is engaged with the lock beam 11, so as to be prevented from being separated for unlocking. At the same time, the push post 92 arranged in the fixed cavity 10 pushes the gun towards the unlocking cavity 20 under the pushing of the first spring 93 to prevent the gun from being loosened.

To unlock the lock to take out the gun, in a first method, a key and the mechanical lock cylinder 51 can be used for cooperative unlocking. The key is inserted into the mechanical lock cylinder 51 and is rotated to drive the mechanical rotating shaft 52 eccentrically arranged at a rear end of the mechanical lock cylinder 51, so that the sliding block 41 is pushed towards one side. The sliding block 41 and the lock beam 11 are disengaged to unlock the lock and take out the gun. The sliding block 41 can then be pushed by the push spring 42 to be reset.

In a second method, electronic unlocking can be used. A user presses a fingerprint recognition window of the fingerprint recognition module 68 with a finger. The fingerprint recognition module 68 recognizes the fingerprint of the user and compares the fingerprint with fingerprints stored in a database. Or, the user inputs a password by using buttons of the button recognition module 70 to decide whether to transmit an unlocking signal to the circuit board 63. When the circuit board 63 receives the unlocking signal, the motor 61 is controlled to clockwise rotate. The cam 62 arranged at a power output end of the motor 61 pushes the sliding block 41 to slide to unlock the lock. The position detection switch 43 arranged on the sliding block 41 then contacts and is triggered by a side wall of the unlocking cavity 20 to provide a signal, which enables the motor 61 to anticlockwise rotate for resetting.

For those skilled in the art, it is apparent that the present disclosure is not limited to the details of the demonstrative embodiments mentioned above, and that the present disclosure can be realized in other specific forms without departing from the spirit or basic features of the present disclosure. Therefore, from any point of view, the embodiments should be regarded as exemplary and non-limiting. The scope of the present disclosure is defined by the appended claims rather than the above description. Therefore, all changes falling within the meanings and scope of equivalent elements of the claims are intended to be included in the present disclosure.

What is claimed is:

1. A lock structure with improved safety, comprising a fixed cavity (10) and an unlocking cavity (20) which are spaced apart from each other by a certain space and are in locked connection, wherein the fixed cavity (10) is provided with a lock beam (11) extending out of the fixed cavity (10); the unlocking cavity (20) is provided with a lockhole (21) for the lock beam (11) to be threaded in, and a locking device (30) for locking the lock beam (11); the lock beam (11) is threaded into a trigger position of a gun and then into the lockhole (21), and is locked by the locking device (30), so that the gun is locked in the space after the fixed cavity (10) and the unlocking cavity (20) are in locked connection; an inner wall of the lockhole (21) extends into the unlocking cavity (20) to form a lockhole ring (22); a convex rib (25) is arranged on an inner wall of the lockhole ring (22); a groove (13) is formed in an outer wall of the lock beam (11);

the lock beam (11) is threaded into the lockhole (21), and moves in the lockhole ring (22); and the convex rib (25) and the groove (13) are connected with each other in an embedded manner, so that the lock beam (11) is stabilized in the lockhole ring (22); the locking device (30) is provided with a spring bolt (31), a spring bolt rack (32), a sliding block (41), a push spring (42) and an unlocking device (50); the spring bolt rack (32) is located on one side of the spring bolt (31) opposite to the lock beam (11); the lock beam (11) is provided with a lock beam rack (12); the lock beam rack (12) and the spring bolt rack (32) are clamped with each other to form locked connection; the unlocking device (50) drives the sliding block (41) to move, thereby driving the spring bolt rack (32) to be separated from the lock beam rack (12) to relieve the locked connection; and the push spring (42) is used for driving the sliding block (41) to reversely move and be reset, thereby driving the spring bolt rack (32) to be in locked connection with the lock beam rack (12) again; a fixing ring (14) and a fixing block (15) which are fixedly connected with each other are arranged inside the fixed cavity (10); the fixing block (15) is fixedly connected inside the fixed cavity (10); an end of the lock beam (11) relative to the lock beam rack (12) is in press-fit with the fixing ring (14), so that the lock beam (11) is fixed in the fixing ring (14); a threaded hole (16) is formed in an end socket of the end of the lock beam (11) pressed into the fixing ring (14), and a pin hole is formed in a position, corresponding to the threaded hole (16), on the fixing block (15); and the lock beam (11) is in bolted connection with the fixing block (15) through the threaded hole (16).

2. The lock structure with the improved safety according to claim 1, wherein one part of a sector ring of the lockhole ring (22) is formed into a long sector ring (23), and another part of the sector ring of the lockhole ring (22) is formed into a short sector ring (24); a distance between a top of the long sector ring (23) and a plane of the lockhole (21) is set to be a first length; a distance between a top of the short sector ring (24) and the plane of the lockhole (21) is set to be a second length; the first length is greater than the second length; a notch (28) is formed in the short sector ring (24) of the lockhole ring (22); and the locking device (30) is in locked connection with the lock beam (11) through the notch (28).

3. The lock structure with the improved safety according to claim 2, wherein two groups of convex ribs (25) are arranged on the inner wall of the lockhole ring (22); two groups of grooves (13) are arranged on the outer wall of the lock beam (11); the two groups of convex ribs (25) and the two groups of grooves (13) are respectively connected with each other in the embedded manner; lengths of one group of convex ribs (25) in an axial direction of the lockhole ring (22) are equal to the first length; and lengths of the other group of convex ribs (25) in the axial direction of the lockhole ring (22) are equal to the second length.

4. The lock structure with the improved safety according to claim 1, wherein the spring bolt rack (32) has a topland (33), a root surface (34) and a bottom land (35); a distance between the topland (33) and the root surface (34) is set to be a first thickness; a distance between the topland (33) and the bottom land (35) is set to be a second thickness; and a numerical value of the first thickness is 0.4 to 0.6 times that of the second thickness.

5. The lock structure with the improved safety according to claim 1, wherein the unlocking device (50) is provided with a mechanical lock cylinder (51), a mechanical rotating shaft (52) and a mechanical key (53); one end of the mechanical rotating shaft (52) is fixedly connected to a rotating component of the mechanical lock cylinder (51); another end of the mechanical rotating shaft (52) abuts against the sliding block (41); the mechanical key (53) is inserted into the mechanical lock cylinder (51) to enable the rotating component to rotate, thereby driving the mechanical rotating shaft (52) to rotate; and the mechanical rotating shaft (52) rotates to drive the sliding block (41), abutting against the mechanical rotating shaft, to move, thereby relieving the locked connection.

6. The lock structure with the improved safety according to claim 1, wherein the unlocking device (50) is provided with a motor (61), a cam (62), a circuit board (63), a processor chip (64), a battery (65), a power data interface (66) and a recognition assembly (67); one end of the cam (62) is fixedly connected to a drive shaft of the motor (61), and another end of the cam (62) abuts against the sliding block (41); the motor (61), the processor chip (64), the battery (65), the power data interface (66) and the recognition assembly (67) are electrically connected to the circuit board (63) respectively; the processor chip (64) is used for driving, according to a recognition result of the recognition assembly (67), the motor (61) to rotate, and driving the cam (62) to rotate; and the cam (62) rotates to drive the sliding block (41), abutting against the cam, to move, thereby relieving the locked connection.

7. The lock structure with the improved safety according to claim 6, wherein the recognition assembly (67) is provided with a fingerprint recognition module (68); the fingerprint recognition module (68) is electrically connected with the circuit board (63); and the fingerprint recognition module (68) is exposed out of a housing of the unlocking cavity (20), so as to facilitate fingerprint recognition.

8. The lock structure with the improved safety according to claim 6, wherein the recognition assembly (67) is provided with a button recognition module; the button recognition module (70) comprises a contact button (71) and a press housing (72); the contact button (71) is electrically connected with the circuit board (63); one end of the press housing (72) abuts against the contact button (71), and another end of the press housing (72) is exposed out of a housing of the unlocking cavity (20), thereby facilitating pressing.

9. The lock structure with the improved safety according to claim 6, wherein the sliding block (41) is provided with a position detection switch (43); the position detection switch (43) is in signal connection with the motor (61); and the position detection switch (43) is triggered intermittently with movement of the sliding block (41) to control the motor (61) to rotate anticlockwise and be reset.

10. The lock structure with the improved safety according to claim 1, wherein the unlocking cavity (20) further comprises a second front shell (202), a second rear shell (203) and a second fixed plate (204); the second front shell (202) is flexibly connected with the fixed cavity (10); the second front shell (202) is fixedly connected with the second rear shell (203) to form a second cavity; both the second fixed plate (204) and the locking device (30) are arranged in the second cavity; the second fixed plate (204) is provided with a sliding chute (205); and the sliding block (41) is arranged in the sliding chute (205), and moves in the sliding chute (205) to be intermittently clamped to and separated from the lock beam (11).

11. The lock structure with the improved safety according to claim 1, wherein the fixed cavity (10) further comprises a first front shell (17), a first rear shell (18) and a push assembly (90); the first front shell (17) is flexibly connected with the unlocking cavity (20), and the first front shell (17)

is fixedly connected with the first rear shell (18) to form a first cavity; and the push assembly (90) is arranged in the first cavity.

12. The lock structure with the improved safety according to claim 11, wherein the push assembly (90) comprises a first fixed plate (91) and a push post (92); the first fixed plate (91) is arranged in the first cavity; both the first front shell (17) and the first fixed plate (91) are provided with through holes (94); the lock beam (11) is arranged on the fixing block (15); the push post (92) abuts against the fixed cavity (10) after passing through the through holes (94).

* * * * *